US008128172B2

(12) United States Patent
Tsai

(10) Patent No.: US 8,128,172 B2
(45) Date of Patent: Mar. 6, 2012

(54) CHAIR ARMREST ASSEMBLY HAVING ADJUSTABLE HEIGHT

(76) Inventor: Po-Chuan Tsai, Tainan Hsien (TW)

( * ) Notice: Subject to any disclaimer, the term of this patent is extended or adjusted under 35 U.S.C. 154(b) by 141 days.

(21) Appl. No.: 12/759,063

(22) Filed: Apr. 13, 2010

(65) Prior Publication Data

US 2011/0248542 A1 Oct. 13, 2011

(51) Int. Cl.
*A47C 7/54* (2006.01)

(52) U.S. Cl. ..... 297/411.36

(58) Field of Classification Search ..... 297/411.36
See application file for complete search history.

(56) References Cited

U.S. PATENT DOCUMENTS

| | | | | |
|---|---|---|---|---|
| 5,620,233 | A * | 4/1997 | Corwin | 297/411.36 |
| 6,974,189 | B2 * | 12/2005 | Machael et al. | 297/411.36 |
| 6,974,190 | B1 * | 12/2005 | Hung | 297/411.36 |
| 6,976,739 | B2 * | 12/2005 | Wang | 297/411.36 X |
| 7,011,371 | B1 * | 3/2006 | Tsai | 297/411.36 |
| 7,066,546 | B2 * | 6/2006 | Trego et al. | 297/411.36 X |
| 7,156,466 | B1 * | 1/2007 | Chang | 297/411.36 |
| 7,448,687 | B2 * | 11/2008 | Tsai | 297/411.36 |
| 7,533,939 | B2 * | 5/2009 | Fookes et al. | 297/411.36 |
| 7,556,316 | B1 * | 7/2009 | Lai | 297/411.36 |
| 7,611,206 | B2 * | 11/2009 | Tsai | 297/411.36 |
| 7,661,763 | B2 * | 2/2010 | Tsai | 297/411.36 |
| 7,744,159 | B2 * | 6/2010 | Lee | 297/411.36 |
| 7,815,259 | B2 * | 10/2010 | Fookes et al. | 297/411.36 X |
| 7,828,389 | B2 * | 11/2010 | Oda | 297/411.36 |
| 7,841,665 | B2 * | 11/2010 | Geister et al. | 297/411.36 |
| 7,896,440 | B2 * | 3/2011 | Tsai | 297/411.36 X |
| 2007/0024100 | A1 * | 2/2007 | Chan | 297/411.36 |
| 2007/0164595 | A1 * | 7/2007 | Chi | 297/411.36 |
| 2008/0277991 | A1 * | 11/2008 | Liu et al. | 297/411.36 |
| 2008/0309140 | A1 * | 12/2008 | Ho | 297/411.36 |
| 2010/0033005 | A1 * | 2/2010 | Lee | 297/411.36 |
| 2011/0248543 | A1 * | 10/2011 | Hitchcock et al. | 297/411.36 |

* cited by examiner

*Primary Examiner* — Rodney B White
(74) *Attorney, Agent, or Firm* — Alan Kamrath; Kamrath IP Lawfirm, PA

(57) ABSTRACT

An armrest assembly for a chair includes an armrest support, a mounting sleeve mounted on the armrest support, an armrest mounted on the mounting sleeve, and a lifting device mounted between the armrest support and the mounting sleeve to lock or unlock the mounting sleeve onto or from the armrest support. Thus, the mounting sleeve is movable relative to the armrest support so as to adjust the height of the armrest so that the height of the armrest can be adjusted freely to support a user's arm comfortably. In addition, a user only needs to pull the armrest upward to adjust the height of the armrest so that the user can adjust the height of the armrest easily and quickly in an energy-saving manner.

20 Claims, 23 Drawing Sheets

CHAIR ARMREST ASSEMBLY HAVING ADJUSTABLE HEIGHT

BACKGROUND OF THE INVENTION

1. Field of the Invention

The present invention relates to an armrest assembly and, more particularly, to an armrest assembly for a chair.

2. Description of the Related Art

A conventional lift device for a chair armrest comprises an upright support post, an adjusting pipe movably mounted on the support post and detachably locked on the support post by a locking piece, and an armrest support mounted on the upper end of the support post. Thus, when the adjusting pipe is unlocked from the locking piece, the adjusting pipe is movable relative to the support post to adjust the height of the armrest support relative to the support post so as to adjust the height of the chair armrest. However, the adjusting pipe is not movable relative to the support post smoothly and stably so that the user cannot move the adjusting pipe relative to the support post easily and conveniently.

BRIEF SUMMARY OF THE INVENTION

In accordance with the present invention, there is provided an armrest assembly, comprising an armrest support, a mounting sleeve movably mounted on the armrest support, an armrest mounted on the mounting sleeve to move in concert with the mounting sleeve, and a lifting device mounted between the armrest support and the mounting sleeve and operable between a first position where the lifting device is locked to lock the mounting sleeve onto the armrest support and a second position where the lifting device is unlocked to unlock the mounting sleeve from the armrest support so that the mounting sleeve is movable relative to the armrest support freely to adjust a relative position between the mounting sleeve and the armrest support.

The lifting device includes a housing secured in the armrest support and having a first side formed with an elongate slideway which has a sidewall formed with a plurality of locking grooves and a second side formed with an elongate guide slot, an adjusting shank movably mounted on the housing and secured in the mounting sleeve to move in concert with the mounting sleeve, a pivot member mounted on a first side of the adjusting shank to move in concert with the adjusting shank and having an upper end pivotally mounted on the adjusting shank and a lower end provided with a locking rod movable in the slideway of the housing and detachably locked in one of the locking grooves of the housing, an elastic member mounted on the first side of the adjusting shank and biased between the adjusting shank and the pivot member to push the locking rod of the pivot member toward one of the locking grooves of the housing, a limit rod mounted on a second side of the adjusting shank to move in concert with the adjusting shank and movable in the guide slot of the housing, and a limit plate movably mounted on the first side of the adjusting shank and connected with the locking rod of the pivot member to drive the locking rod of the pivot member to detach from the locking grooves of the housing.

The primary objective of the present invention is to provide a chair armrest assembly having a height adjustable function.

According to the primary objective of the present invention, the mounting sleeve is movable relative to the armrest support so as to adjust the height of the armrest so that the height of the armrest can be adjusted freely to support a user's arm comfortably.

According to another objective of the present invention, a user only needs to pull the armrest upward to adjust the height of the armrest so that the user can adjust the height of the armrest easily and quickly in an energy-saving manner.

According to another objective of the present invention, the adjusting shank is moved on the housing by guidance of the limit rod so that the mounting sleeve is movable relative to the armrest support smoothly and stably so as to facilitate the user adjusting the height of the armrest.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
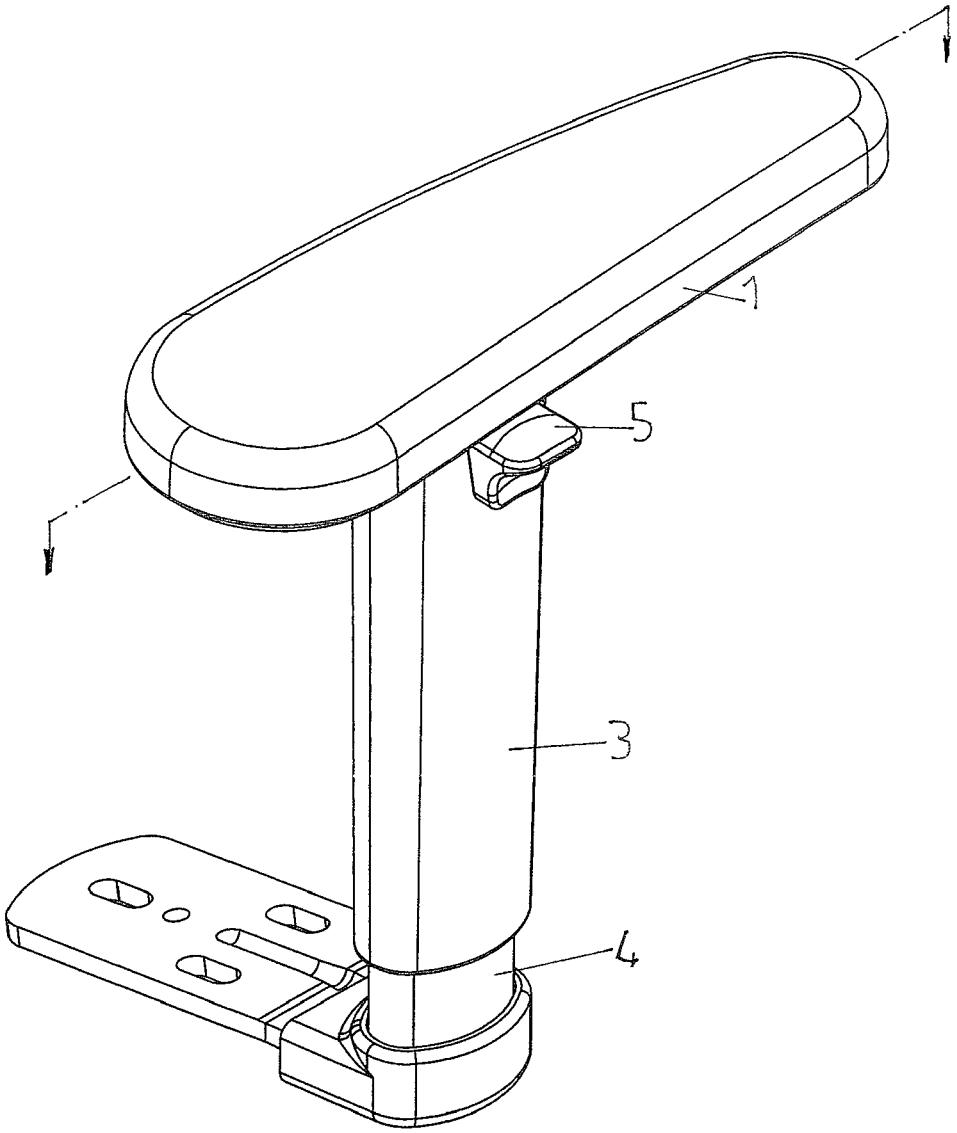
FIG. 1 is a perspective view of an armrest assembly for a chair in accordance with the preferred embodiment of the present invention.
Figure 2:
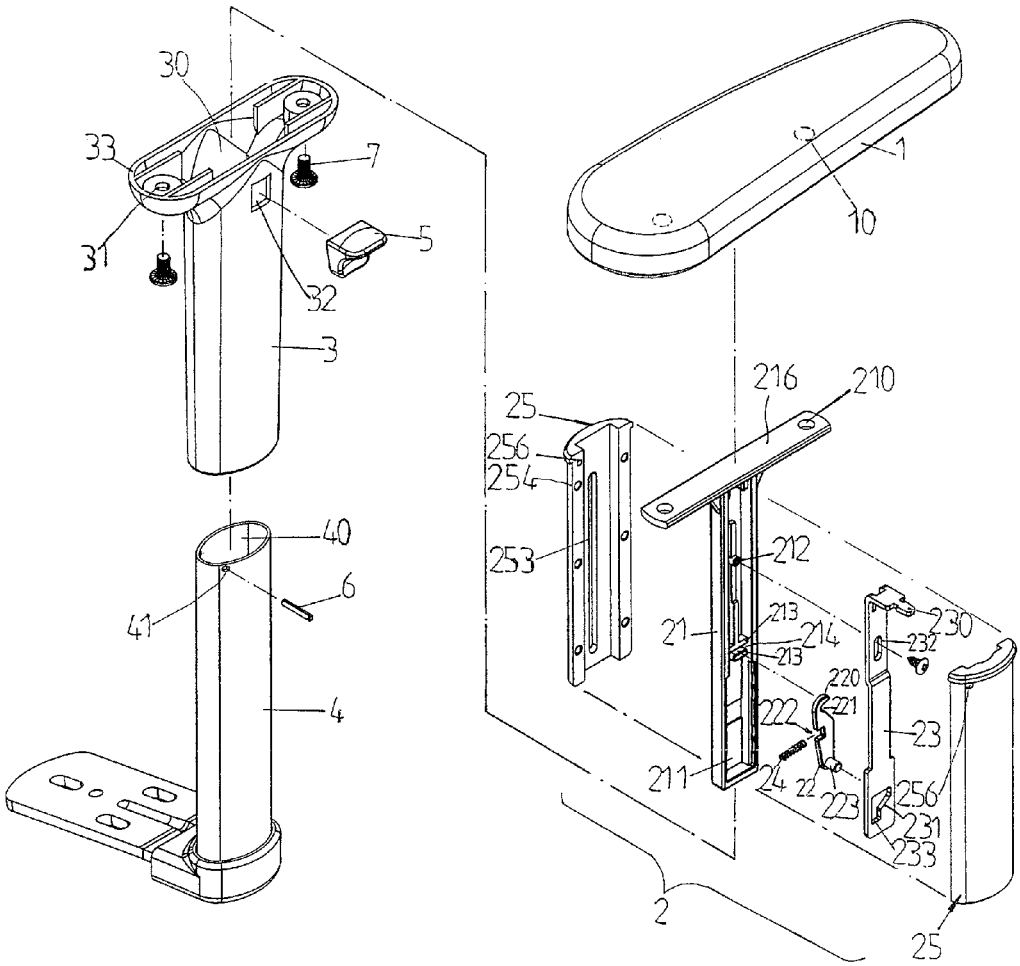
FIG. 2 is an exploded perspective view of the armrest assembly as shown in FIG. 1.
Figure 3:
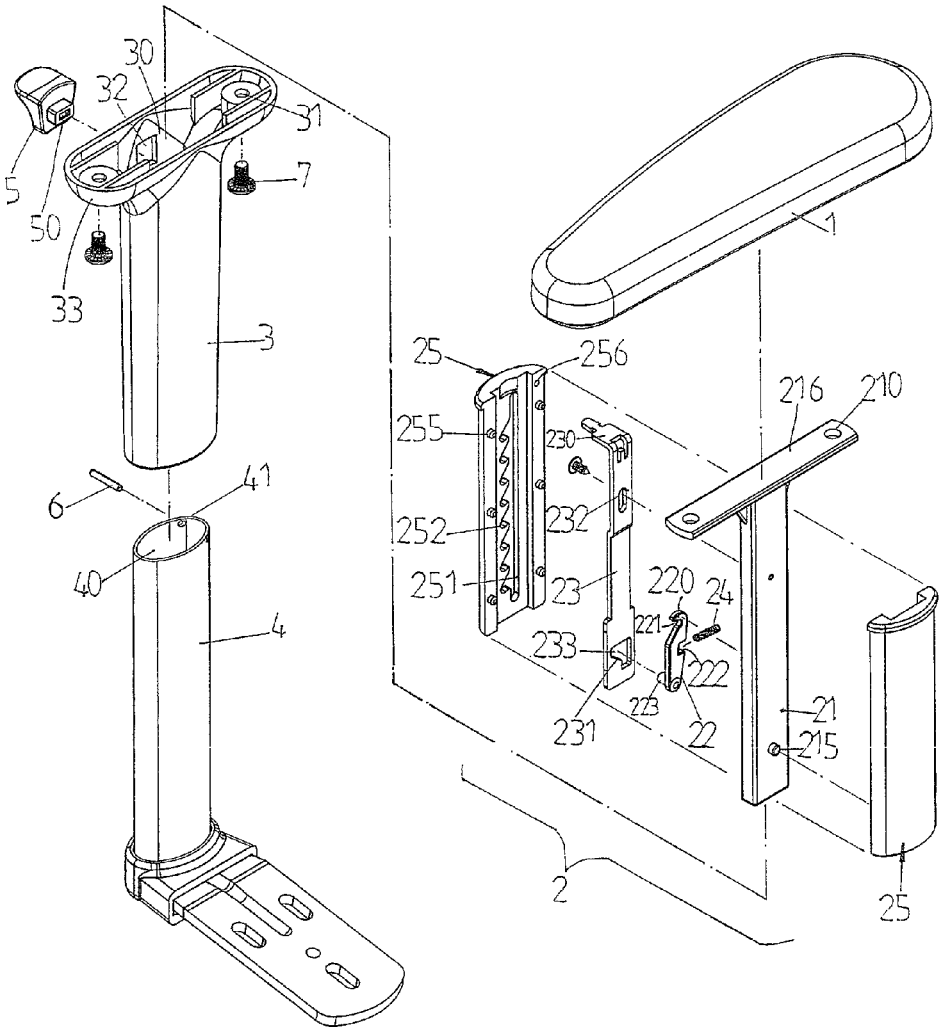
FIG. 3 is an exploded perspective view of the armrest assembly as shown in FIG. 1.
Figure 4:
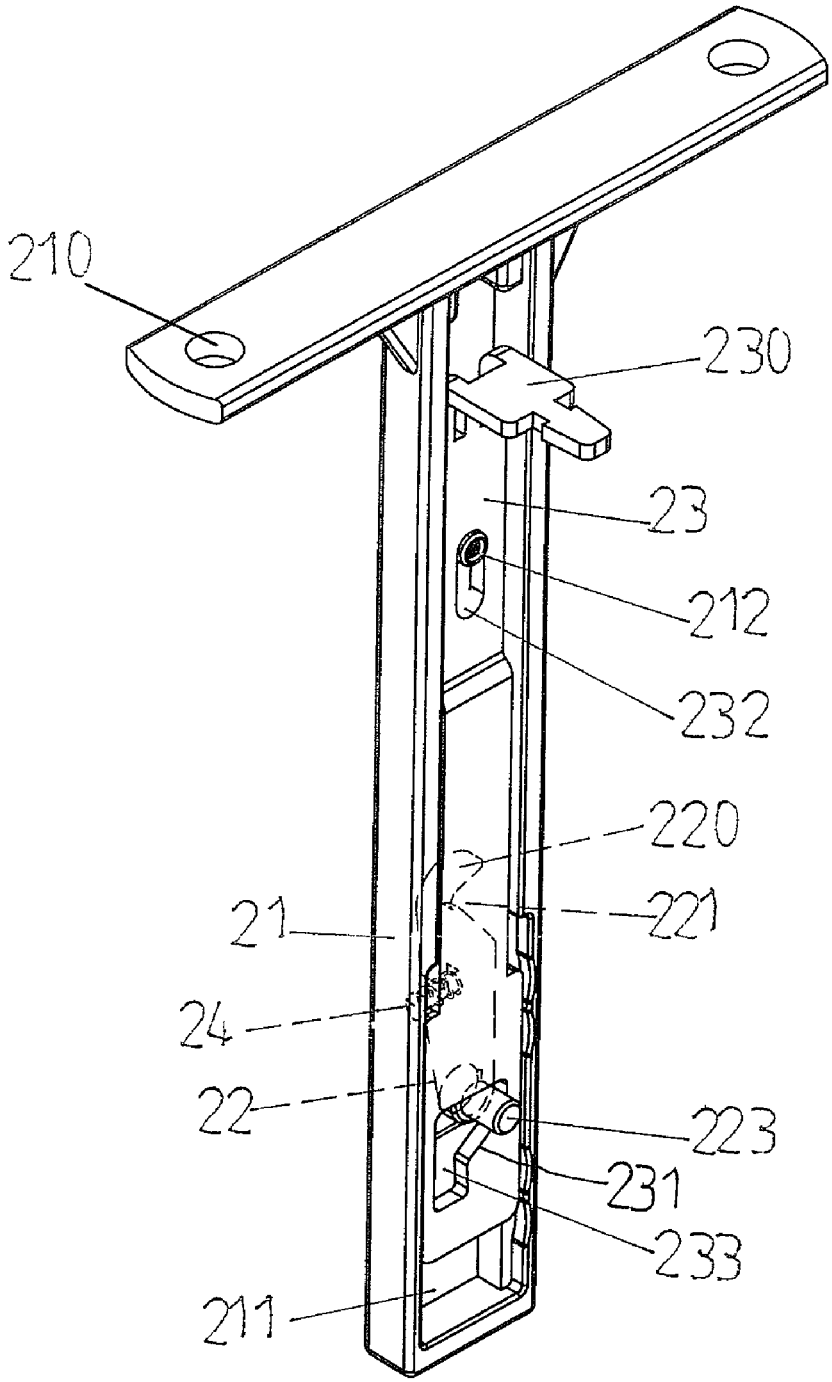
FIG. 4 is a partially perspective view of the armrest assembly as shown in FIG. 1.

Referring to the drawings and initially to FIGS. 1-12, an armrest assembly for a chair in accordance with the preferred embodiment of the present invention comprises an armrest support 4, a mounting sleeve 3 movably mounted on the armrest support 4, an armrest 1 mounted on the mounting sleeve 3 to move in concert with the mounting sleeve 3, and a lifting device 2 mounted between the armrest support 4 and the mounting sleeve 3 and operable between a first position where the lifting device 2 is locked to lock the mounting sleeve 3 onto the armrest support 4 and a second position where the lifting device 2 is unlocked to unlock the mounting sleeve 3 from the armrest support 4 so that the mounting sleeve 3 is movable relative to the armrest support 4 freely to adjust a relative position between the mounting sleeve 3 and the armrest support 4.

The armrest support 4 is hollow and has an inner portion formed with a receiving chamber 40 to receive the lifting device 2. The armrest support 4 has an upper end formed with two opposite pin holes 41 each connected to the receiving chamber 40.

The mounting sleeve 3 is hollow and has an inner portion formed with a mounting hole 30 slidably mounted on the armrest support 4. The mounting sleeve 3 has an enlarged top 33 formed with two through holes 31. The mounting sleeve 3 has a side face formed with a passage 32 connected to the mounting hole 30.

The lifting device 2 includes a housing 25 secured in the armrest support 4 and having a first side formed with an elongate slideway 251 which has a sidewall formed with a plurality of locking grooves 252 and a second side formed with an elongate guide slot 253, an adjusting shank 21 movably mounted on the housing 25 and secured in the mounting sleeve 3 to move in concert with the mounting sleeve 3, a pivot member 22 mounted on a first side of the adjusting shank 21 to move in concert with the adjusting shank 21 and having an upper end pivotally mounted on the adjusting shank 21 and a lower end provided with a locking rod 223 movable in the slideway 251 of the housing 25 and detachably locked in one of the locking grooves 252 of the housing 25, an elastic member 24 mounted on the first side of the adjusting shank 21 and biased between the adjusting shank 21 and the pivot member 22 to push the locking rod 223 of the pivot member 22 toward one of the locking grooves 252 of the housing 25, a limit rod 215 mounted on a second side of the adjusting shank 21 to move in concert with the adjusting shank 21 and movable in the guide slot 253 of the housing 25, and a limit plate 23 movably mounted on the first side of the adjusting shank 21 and connected with the locking rod 223 of the pivot member 22 to drive the locking rod 223 of the pivot member 22 to detach from the locking grooves 252 of the housing 25.

The housing 25 of the lifting device 2 is mounted in the receiving chamber 40 of the armrest support 4 and has an upper end provided with a pin bore 256 aligning with the two pin holes 41 of the armrest support 4, and the armrest further comprises a fixing pin 6 extending through the two pin holes 41 of the armrest support 4 and the pin bore 256 of the housing 25 to secure the housing 25 of the lifting device 2 to the armrest support 4. The housing 25 of the lifting device 2 consists of two recessed support boards which are combined together. One of the two support boards of the housing 25 has a periphery provided with a plurality of locating holes 254, and the other one of the two support boards of the housing 25 has a periphery provided with a plurality of locating stubs 255 inserted into the locating holes 254 so that the two support boards of the housing 25 are combined together.

The adjusting shank 21 of the lifting device 2 has a substantially T-shaped profile and has an elongate top 216 formed with two through bores 210. The first side of the adjusting shank 21 is formed with a receiving channel 211 which receives the pivot member 22, the limit plate 23 and the elastic member 24. The first side of the adjusting shank 21 has an upper end provided with a stop stub 212 and a lower end provided with two support bars 213 and a receiving space 214 between the two support bars 213.

The pivot member 22 of the lifting device 2 has a mediate portion formed with a receiving recess 222 which receives the elastic member 24. The upper end of the pivot member 22 is formed with an arcuate pivot groove 221 pivotally mounted on a lower one of the two support bars 213 of the adjusting shank 21. The upper end of the pivot member 22 is formed with a hooked limit block 220 movably mounted in the receiving space 214 of the adjusting shank 21 and limited between the two support bars 213 of the adjusting shank 21. The limit block 220 of the pivot member 22 is located above the pivot groove 221 of the pivot member 22, and the receiving recess 222 of the pivot member 22 is located between the pivot groove 221 and the locking rod 223 of the pivot member 22.

The limit plate 23 of the lifting device 2 has a substantially inverted L-shaped cross-sectional profile and has a top formed with a bent extension 230 extending through and protruding outwardly from the passage 32 of the mounting sleeve 3. The limit plate 23 of the lifting device 2 is movable in concert with the adjusting shank 21 and has an upper end formed with an oblong sliding slot 232 slidable on the stop stub 212 of the adjusting shank 21. The limit plate 23 of the lifting device 2 has lower end formed with a substantially inverted L-shaped limit slot 233 in which the locking rod 223 of the pivot member 22 is slidable. The limit slot 233 of the limit plate 23 has a side formed with a guide ramp 231 to guide movement of the locking rod 223 of the pivot member 22 relative to the limit slot 233 of the limit plate 23.

The armrest assembly further comprises a control knob 5 mounted on the extension 230 of the limit plate 23 to drive and move the limit plate 23 relative to the adjusting shank 21. The control knob 5 is located outside of the mounting sleeve 3 and has a side formed with a socket 50 mounted on the extension 230 of the limit plate 23.

The armrest 1 is mounted on the top 33 of the mounting sleeve 3. The armrest 1 has a bottom provided with two screw bores 10, and the armrest further comprises two fixing screws 7 in turn extended through the through holes 31 of the mounting sleeve 3 and the through bores 210 of the adjusting shank 21 respectively and screwed into the screw bores 10 of the armrest 1 respectively to combine the armrest 1, the mounting sleeve 3 and the adjusting shank 21 of the lifting device 2.

Figure 5:
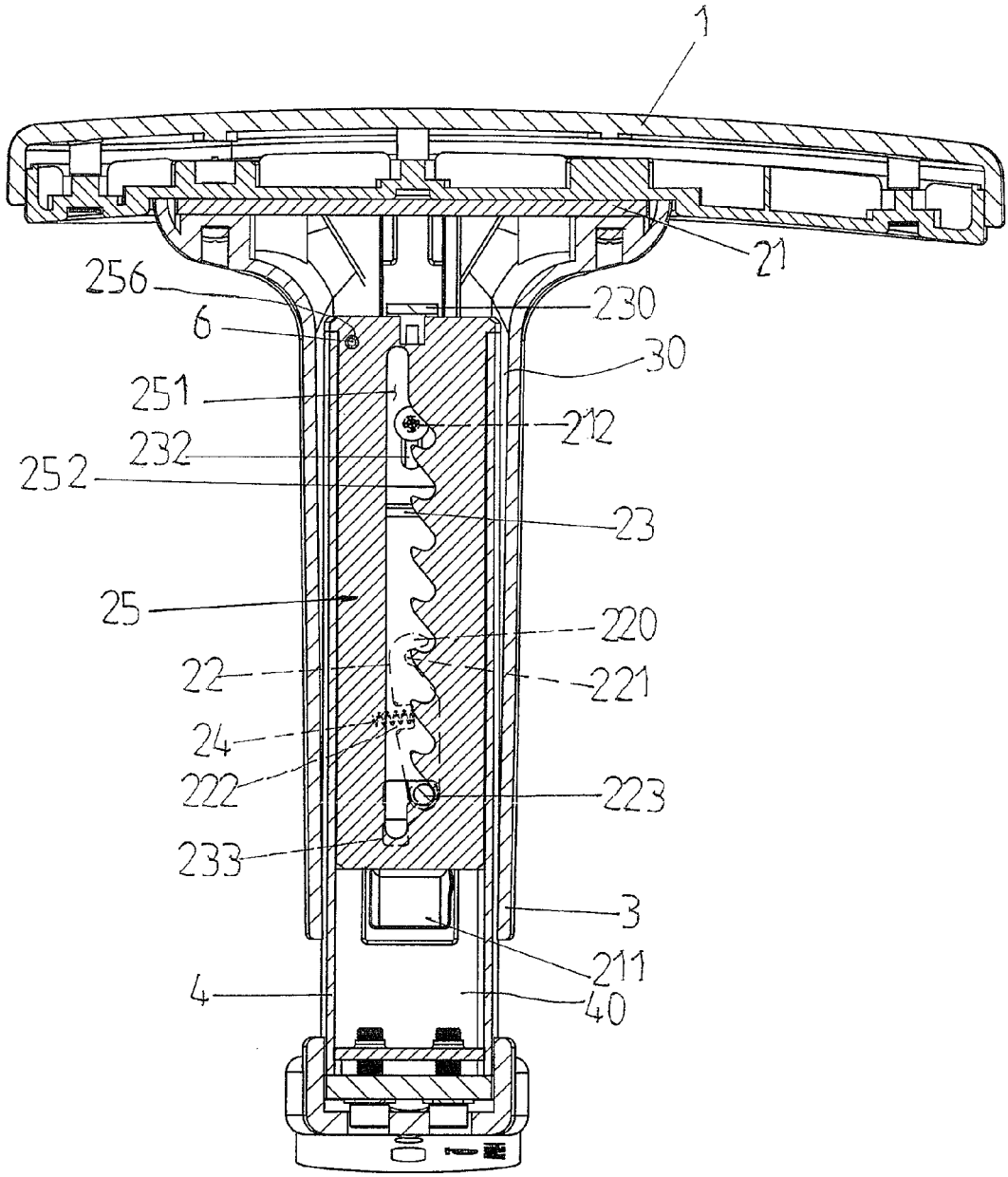
FIG. 5 is a front cross-sectional view of the armrest assembly as shown in FIG. 1.
Figure 6:
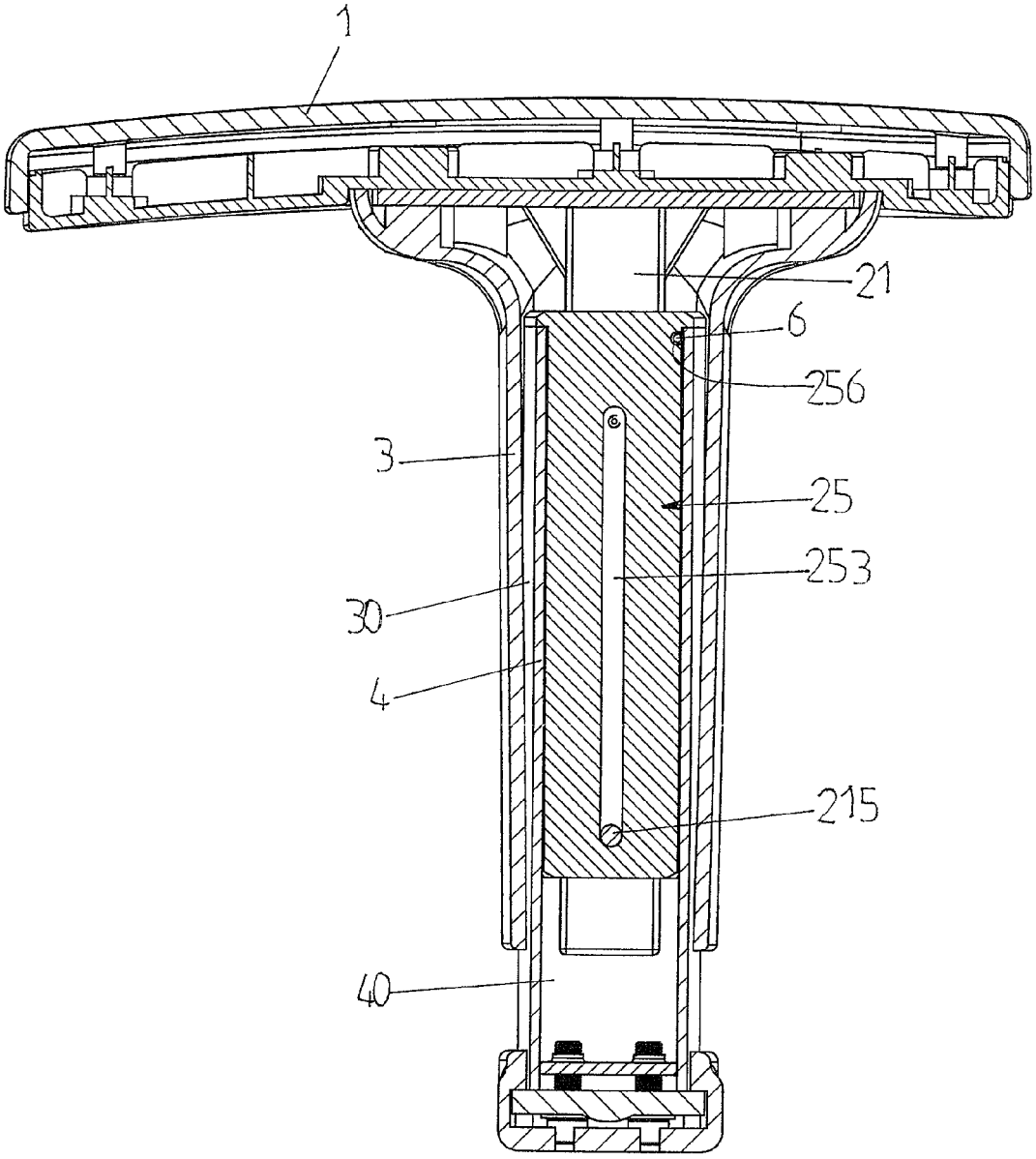
FIG. 6 is a rear cross-sectional view of the armrest assembly as shown in FIG. 1.

Referring to FIGS. 5 and 6 with reference to FIGS. 1-4, when the lifting device 2 is disposed at a normal state, the locking rod 223 of the pivot member 22 is located at the uppermost and rightmost side of the limit slot 233 of the limit plate 23 and is locked in the lowermost one of the locking grooves 252 of the housing 25 as shown in FIG. 5, the stop stub 212 of the adjusting shank 21 is located at the top of the sliding slot 232 of the limit plate 23 as shown in FIG. 5, and the limit rod 215 is located at the bottom of the guide slot 253 of the housing 25 as shown in FIG. 6.

Figure 7:
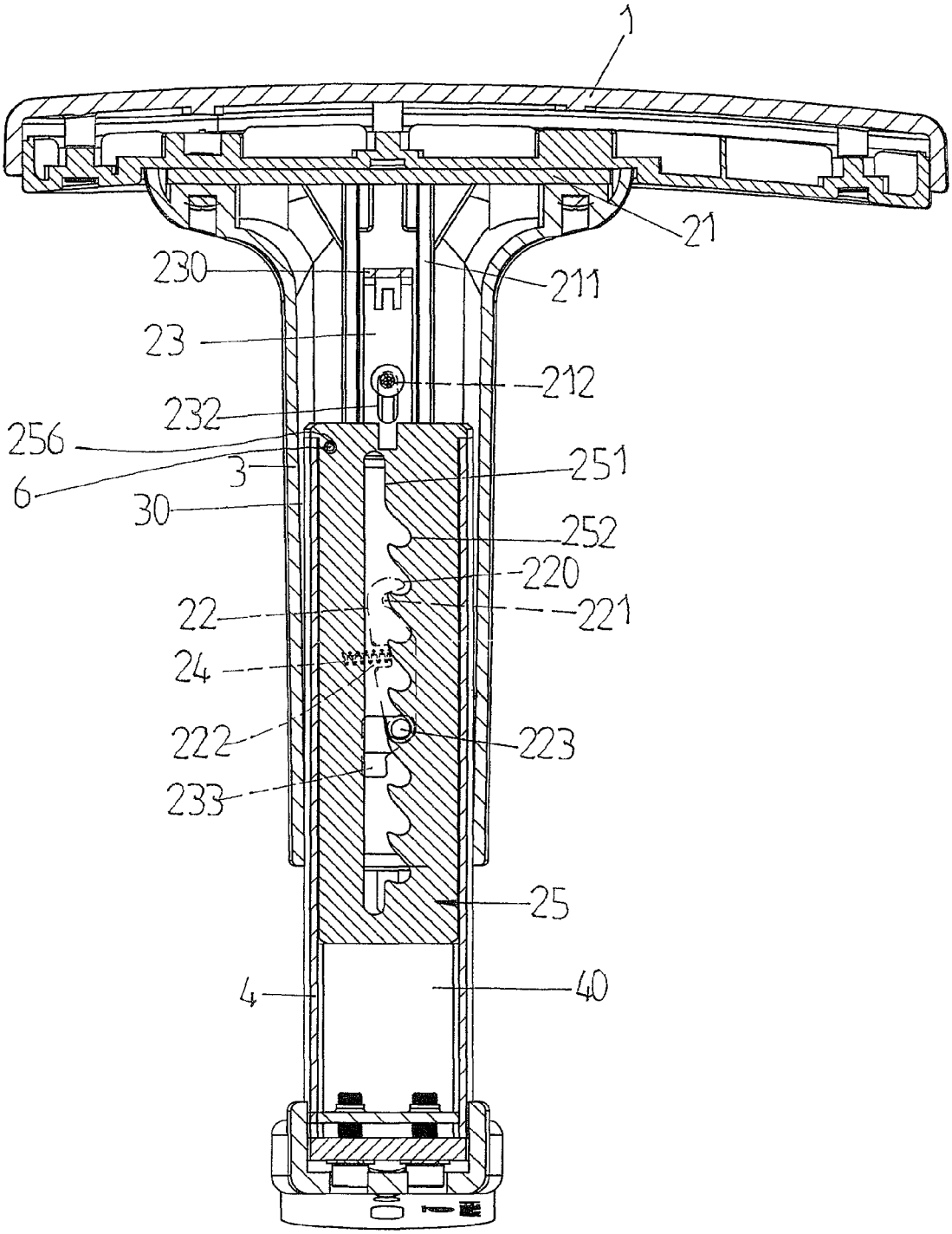
FIG. 7 is a schematic operational view of the armrest assembly as shown in FIG. 5.

In operation, referring to FIGS. 7-12 with reference to FIGS. 1-6, when the armrest 1 is pulled upward, the mounting sleeve 3 and the adjusting shank 21 are moved upward relative to the armrest support 4 so that the pivot member 22 is moved upward relative to the housing 25, and the locking rod 223 of the pivot member 22 is pushed leftward by the wall defining the locking grooves 252 of the housing 25 to detach from one of the locking grooves 252 of the housing 25 and to extend into the slideway 251 of the housing 25. At this time, when the locking rod 223 of the pivot member 22 is pushed leftward by the wall defining the locking grooves 252 of the housing 25, the pivot groove 221 of the pivot member 22 is pivoted about the lower one of the two support bars 213 of the adjusting shank 21 so that the pivot member 22 is pivoted leftward to compress the elastic member 24. When the adjusting shank 21 and the pivot member 22 are further moved upward relative to the housing 25, the locking rod 223 of the pivot member 22 is pushed toward the locking grooves 252 of the housing 25 by the restoring force of the elastic member 24 so that the locking rod 223 of the pivot member 22 is inserted into and locked in another one of the locking grooves 252 of the housing 25 as shown in FIG. 7 to lock the adjusting shank 21 onto the housing 25 and to lock the mounting sleeve 3 onto the armrest support 4. In such a manner, when the armrest 1 is pulled upward, the mounting sleeve 3 is moved upward relative to the armrest support 4 successively so as to adjust the height of the armrest 1 of the chair.

Figure 8:
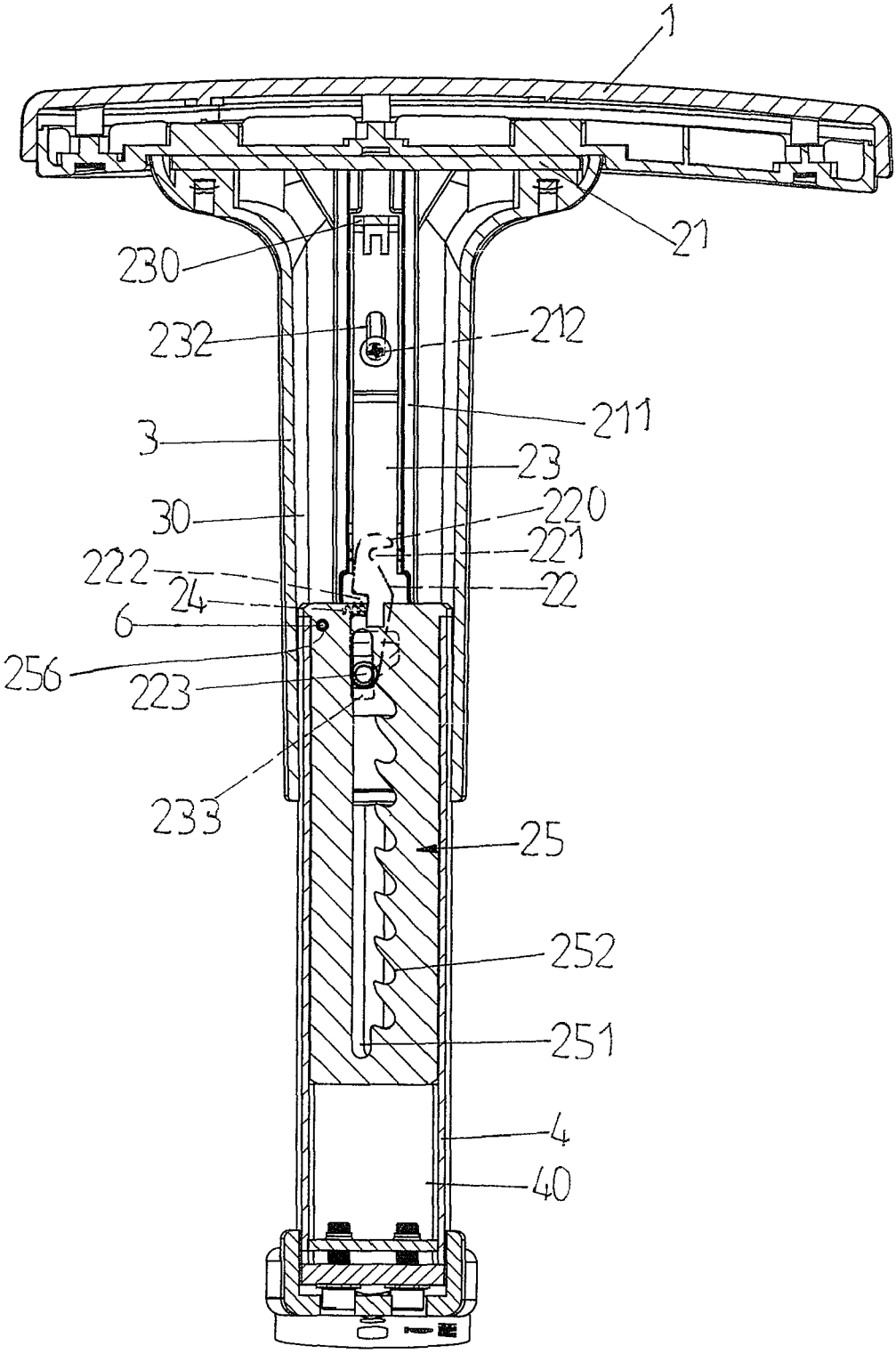
FIG. 8 is a schematic operational view of the armrest assembly as shown in FIG. 7.
Figure 9:
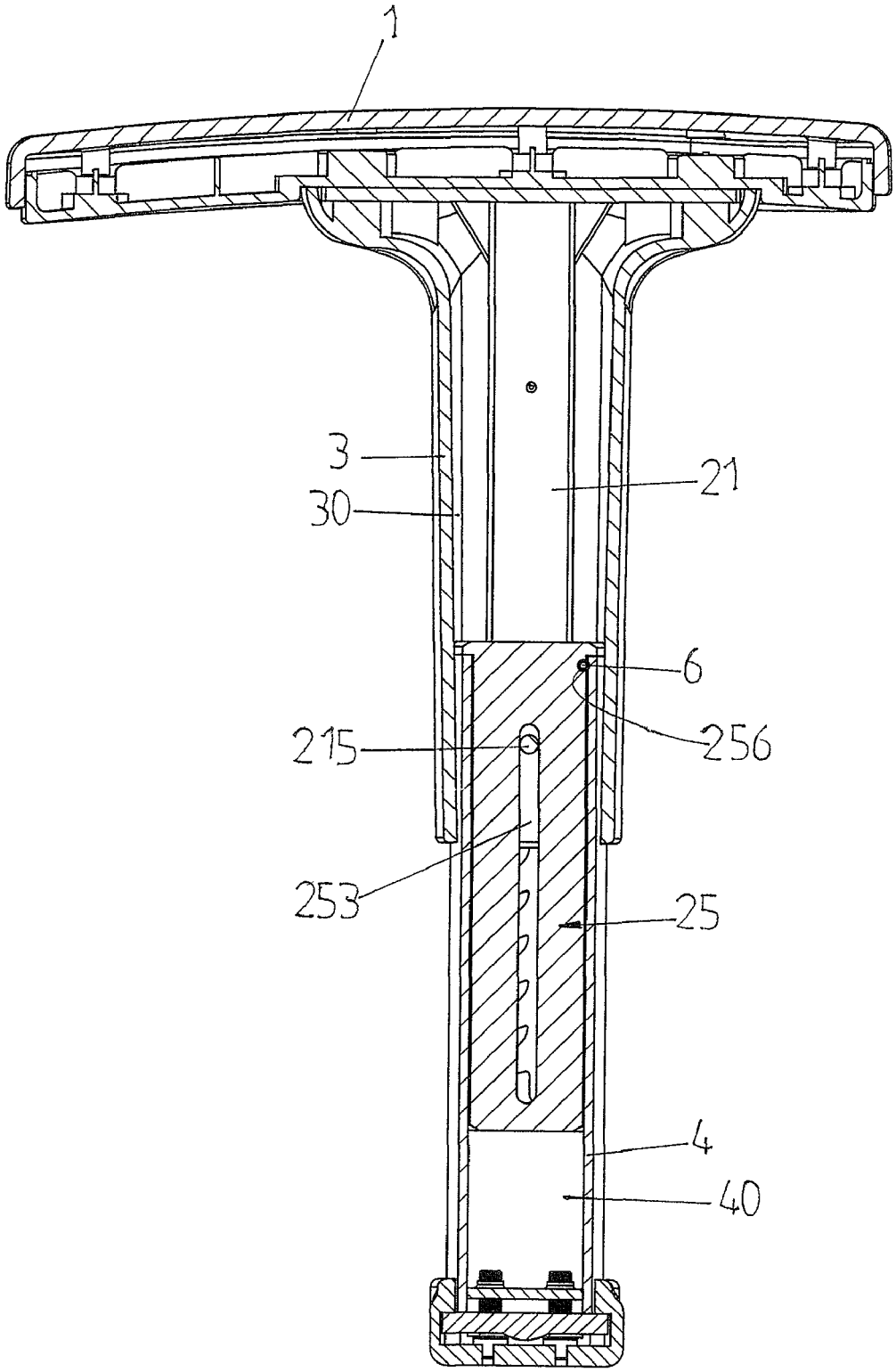
FIG. 9 is a schematic operational view of the armrest assembly as shown in FIG. 6.

As shown in FIGS. 8 and 9, when the adjusting shank 21 and the pivot member 22 are further moved upward relative to the housing 25, the limit rod 215 is moved to abut the top of the guide slot 253 of the housing 25 as shown in FIG. 9, so that the adjusting shank 21 and the pivot member 22 are stopped and cannot further be moved upward relative to the housing 25. At the same time, the locking rod 223 of the pivot member 22 is pushed leftward by the wall defining the locking grooves 252 of the housing 25 so that the locking rod 223 of the pivot member 22 is detached from the uppermost one of the locking grooves 252 of the housing 25 and is extended into the slideway 251 of the housing 25 as shown in FIG. 8. In addition, the locking rod 223 of the pivot member 22 is located at the uppermost and leftmost side of the limit slot 233 of the limit plate 23.

Figure 10:
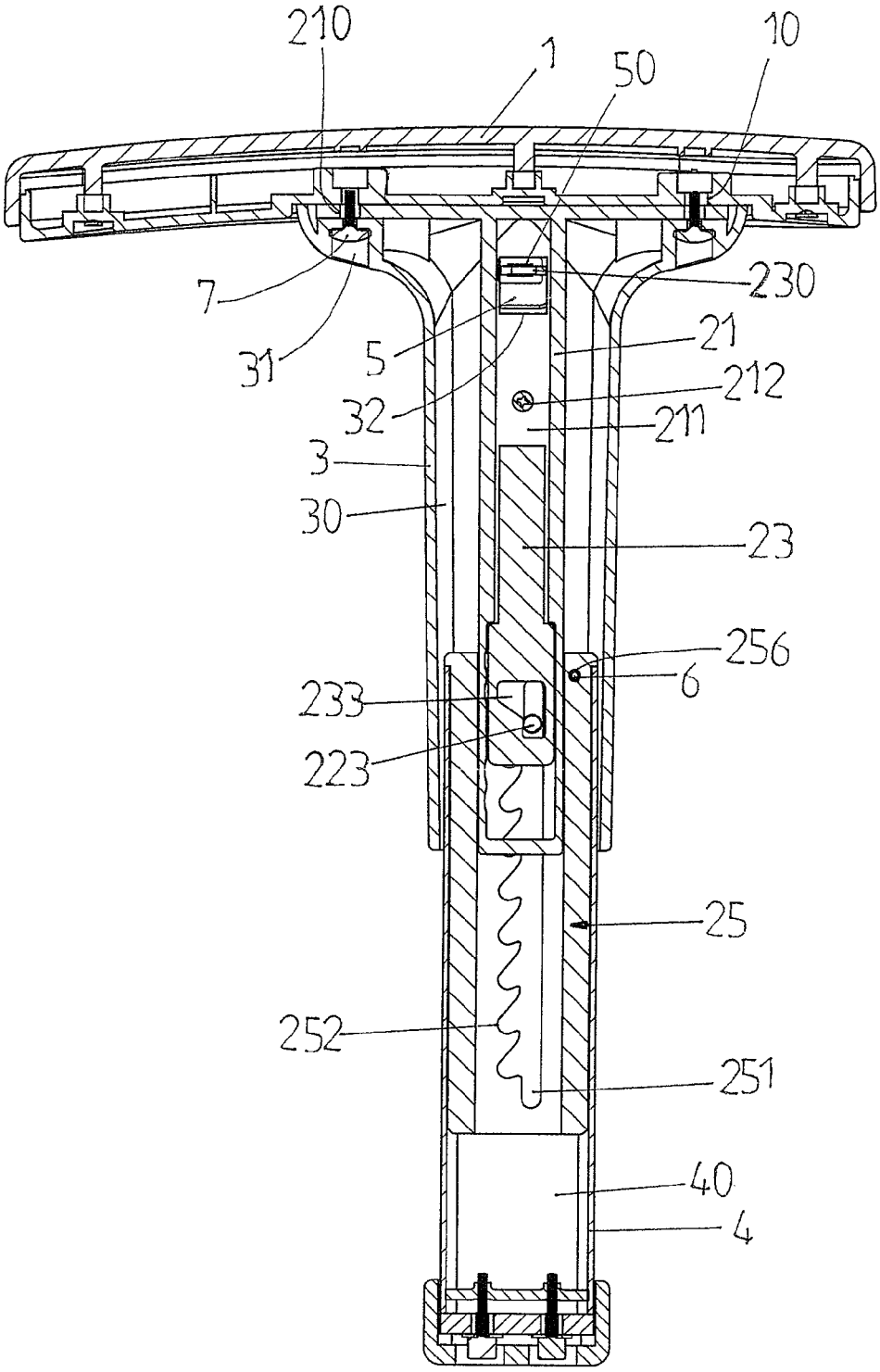
FIG. 10 is a rear view of the armrest assembly as shown in FIG. 8.

As shown in FIGS. 8 and 10, when the control knob 5 is pulled upward, the extension 230 of the limit plate 23 is pulled upward so that the limit plate 23 is moved upward relative to the adjusting shank 21 and the pivot member 22 until the stop stub 212 of the adjusting shank 21 is located at the bottom of the sliding slot 232 of the limit plate 23. In such a manner, when the limit plate 23 is moved upward relative to the pivot member 22, the locking rod 223 of the pivot member 22 is moved downward in the limit slot 233 of the limit plate 23 to abut the lowermost and leftmost side of the limit slot 233 of the limit plate 23 so that the locking rod 223 of the pivot member 22 is locked by the limit slot 233 of the limit plate 23 and cannot be pushed toward the locking grooves 252 of the housing 25 by the restoring force of the elastic member 24. Thus, the adjusting shank 21 and the pivot member 22 are moved downward relative to the housing 25 freely and are moved from the position as shown in FIG. 8 to the position as shown in FIG. 11 so that the mounting sleeve 3 is moved downward relative to the armrest support 4 freely and successively so as to lower of the armrest 1 of the chair.

Figure 11:
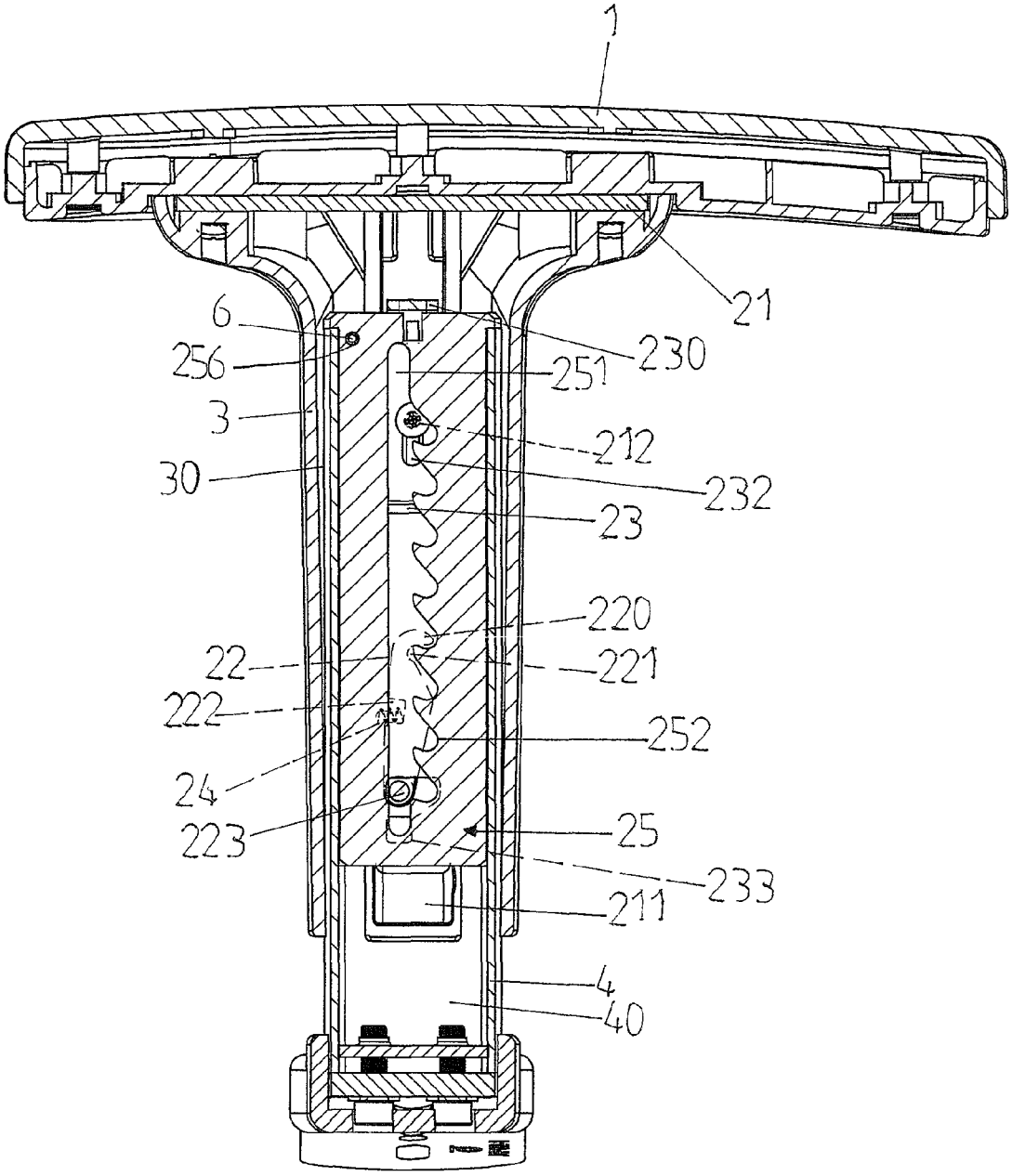
FIG. 11 is a schematic operational view of the armrest assembly as shown in FIG. 8.
Figure 12:
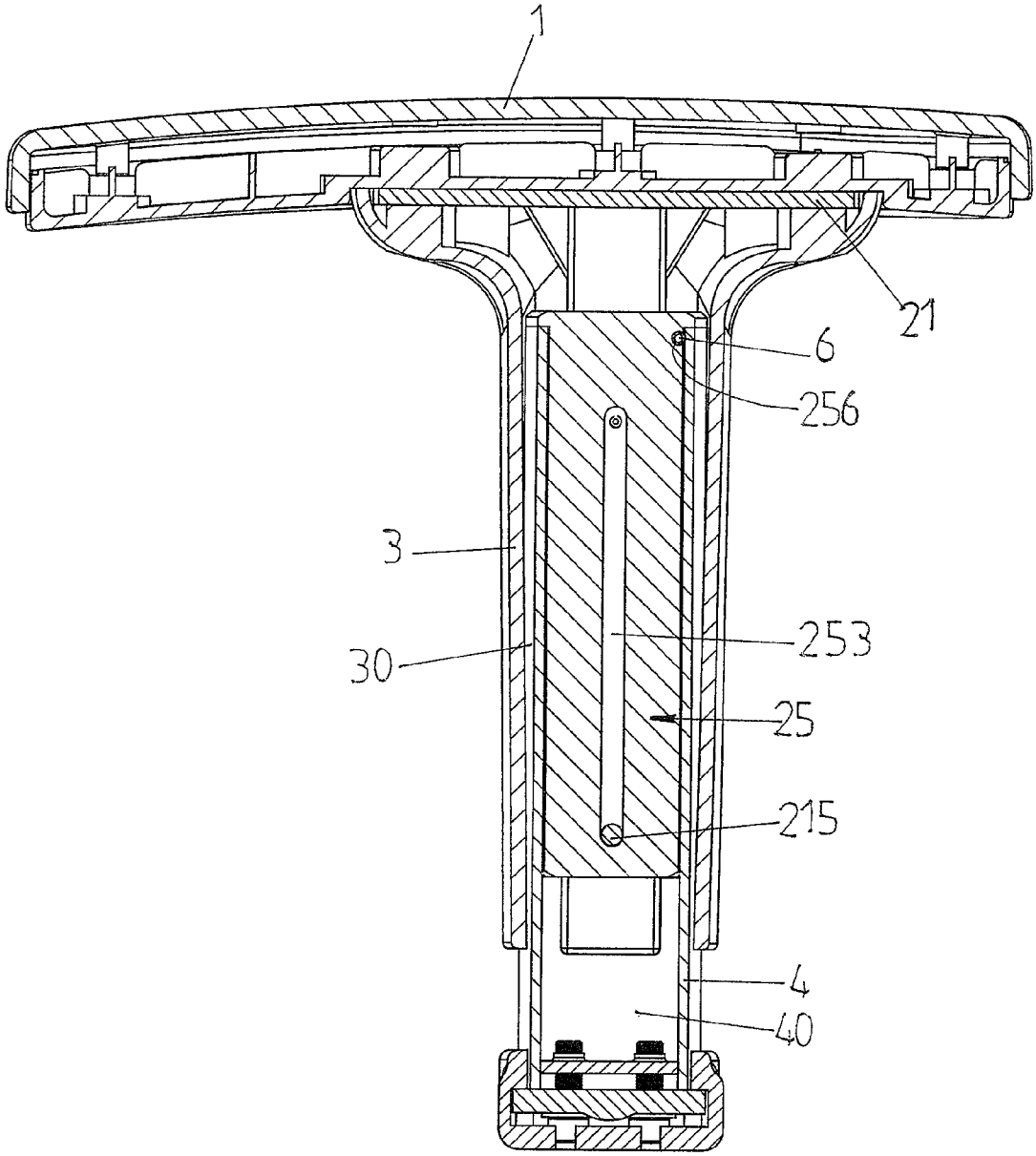
FIG. 12 is a schematic operational view of the armrest assembly as shown in FIG. 9.
Figure 13:
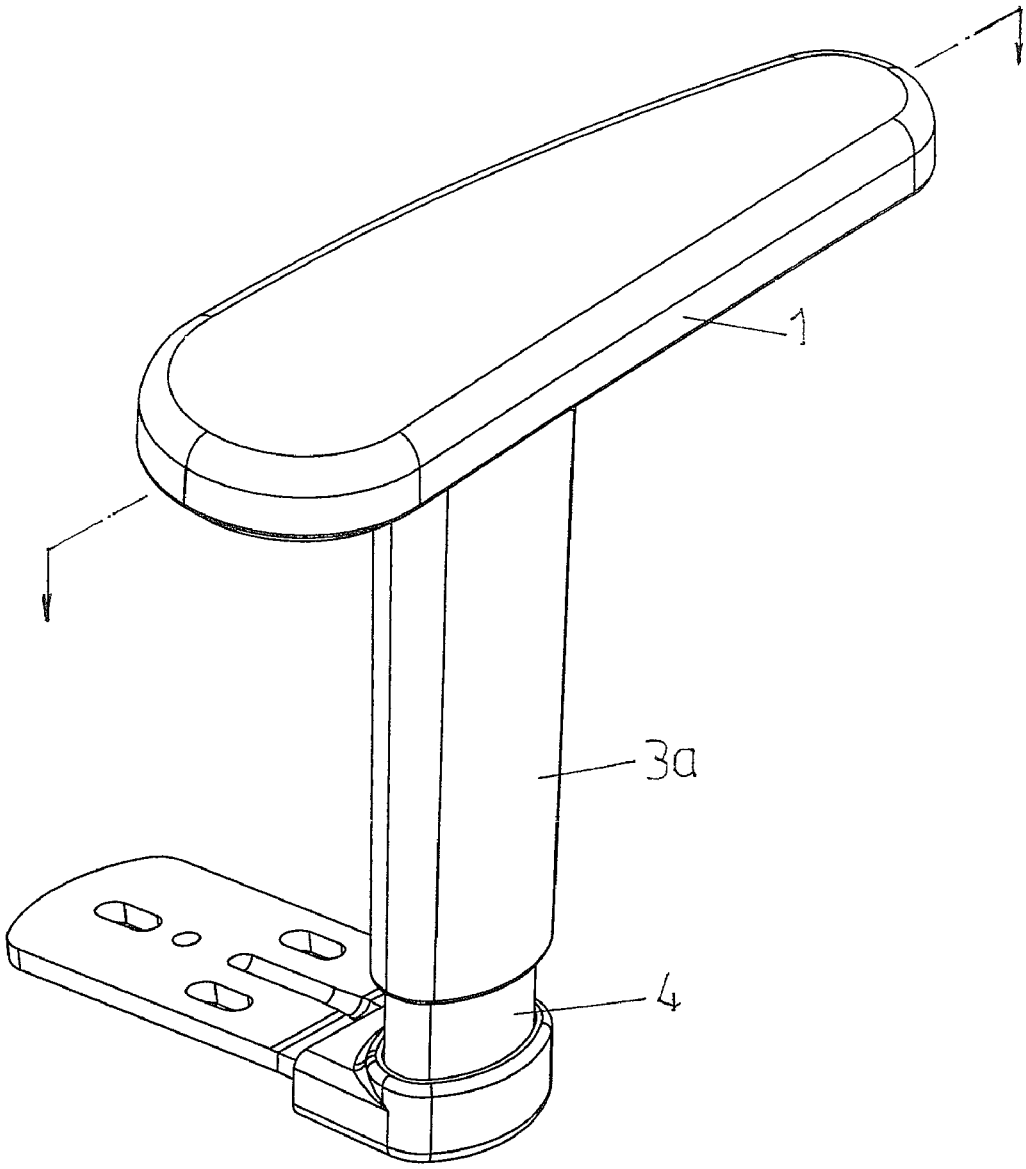
FIG. 13 is a perspective view of an armrest assembly for a chair in accordance with another preferred embodiment of the present invention.
Figure 14:
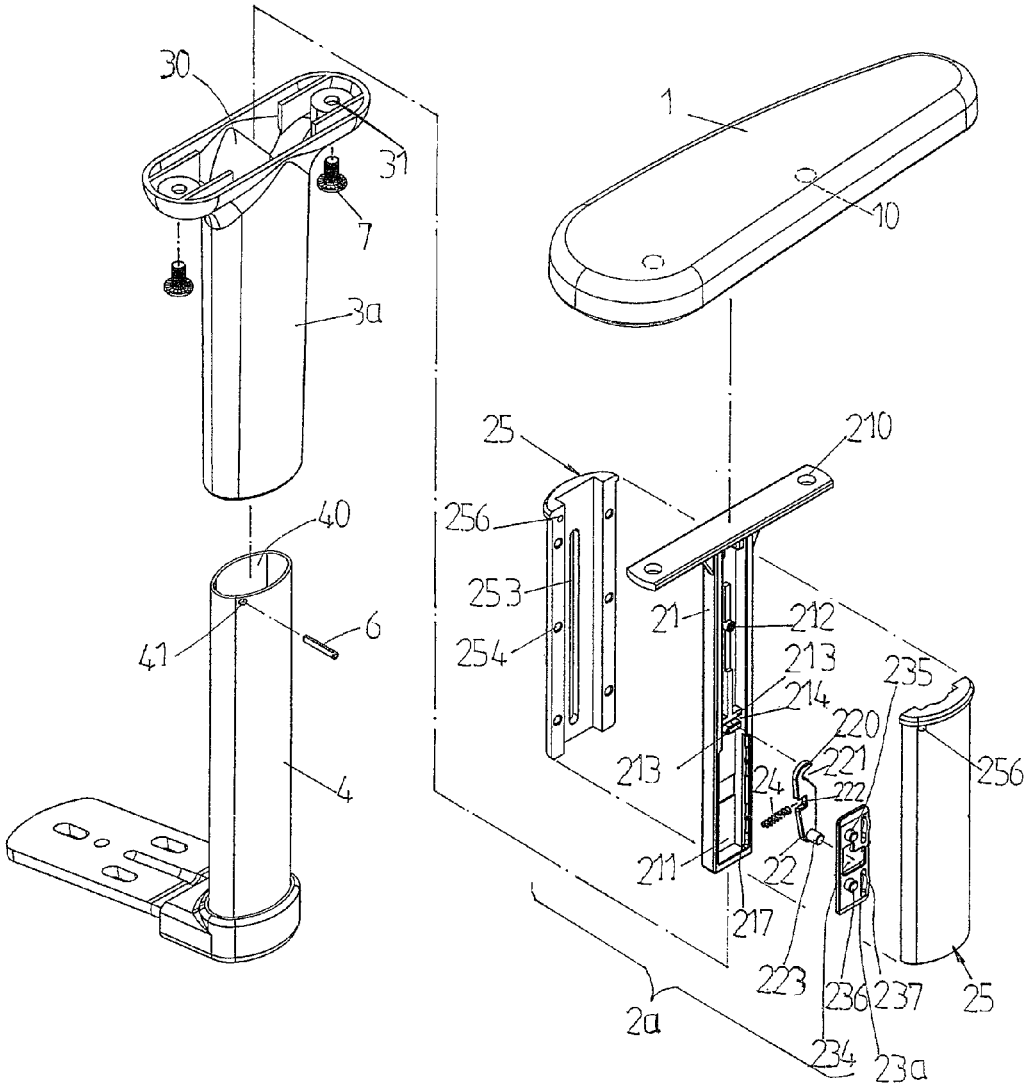
FIG. 14 is an exploded perspective view of the armrest assembly as shown in FIG. 13.
Figure 15:
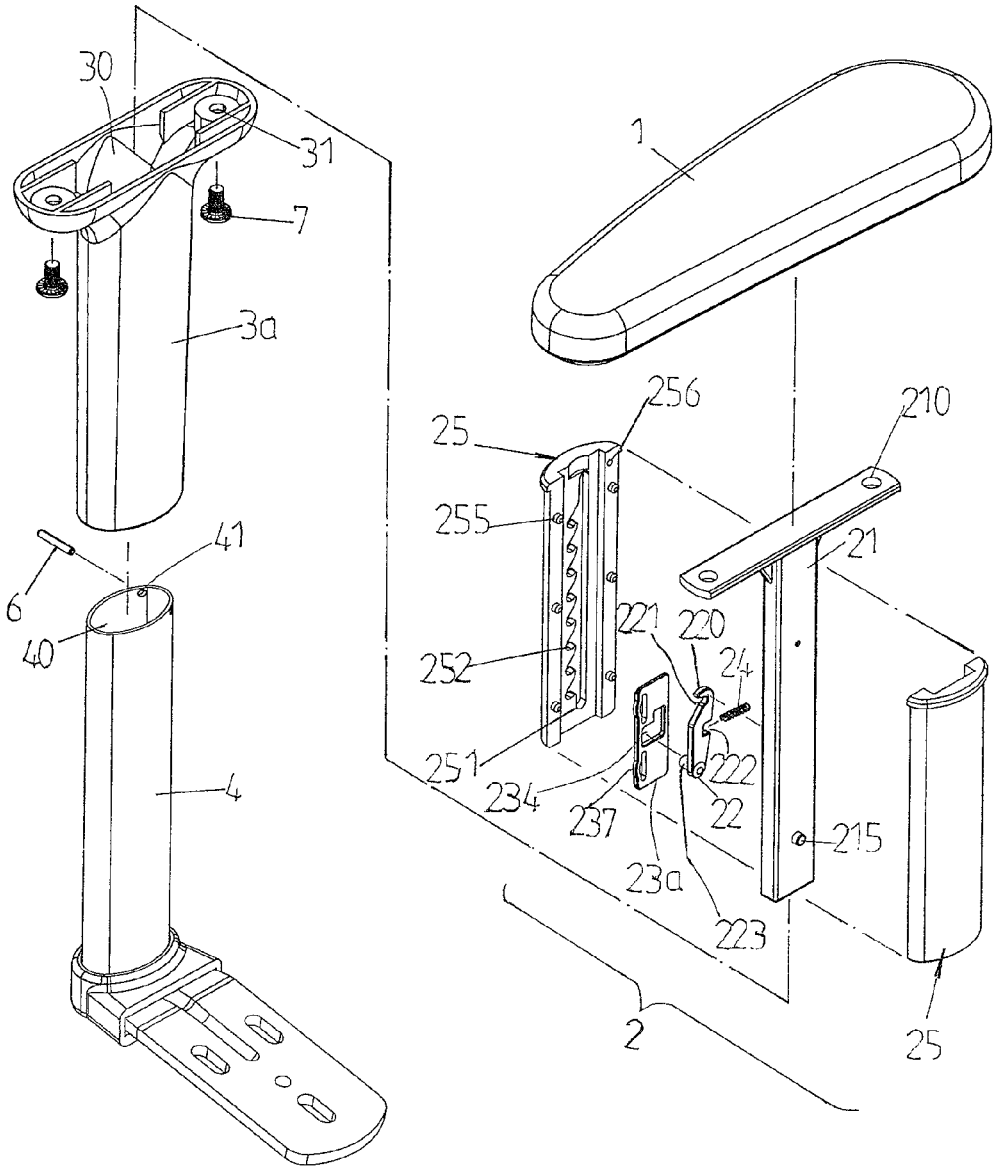
FIG. 15 is an exploded perspective view of the armrest assembly as shown in FIG. 13.
Figure 16:
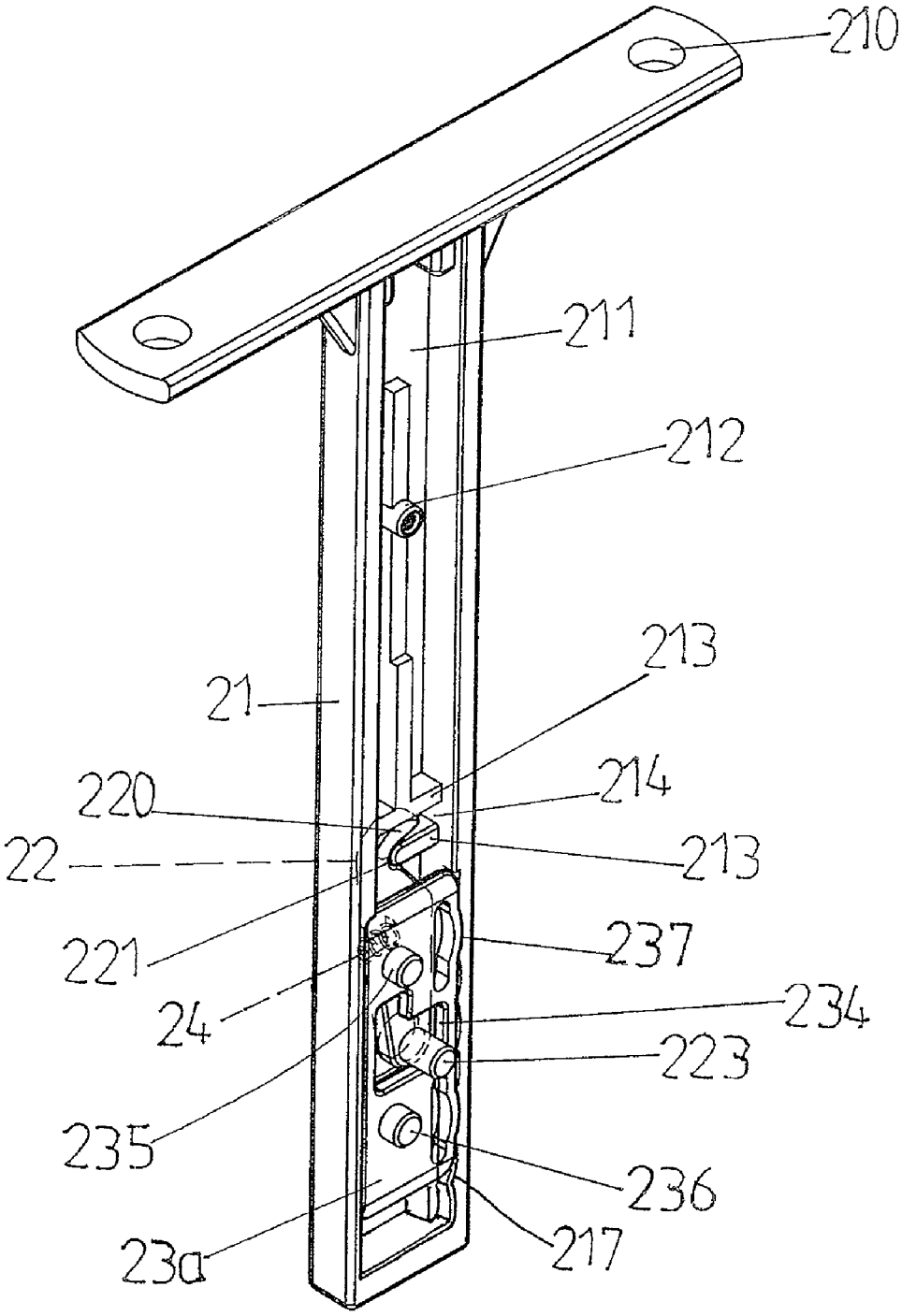
FIG. 16 is a partially perspective view of the armrest assembly as shown in FIG. 13.

As shown in FIGS. 11 and 12, when the adjusting shank 21 and the pivot member 22 are further moved downward relative to the housing 25, the limit rod 215 is moved to abut the bottom of the guide slot 253 of the housing 25 as shown in FIG. 12, so that the adjusting shank 21 and the pivot member 22 are stopped and cannot further be moved downward relative to the housing 25. In such a manner, when the control knob 5 is pushed downward, the extension 230 of the limit plate 23 is pushed downward so that the limit plate 23 is moved downward relative to the adjusting shank 21 and the pivot member 22 until the stop stub 212 of the adjusting shank 21 is located at the top of the sliding slot 232 of the limit plate 23. At this time, when the limit plate 23 is moved downward relative to the pivot member 22, the locking rod 223 of the pivot member 22 is moved upward in the limit slot 233 of the limit plate 23 to abut the uppermost and leftmost side of the limit slot 233 of the limit plate 23 as shown in FIG. 11 so that the locking rod 223 of the pivot member 22 is unlocked from the limit slot 233 of the limit plate 23. Thus, the locking rod 223 of the pivot member 22 is pushed toward the locking grooves 252 of the housing 25 by the restoring force of the elastic member 24 so that the locking rod 223 of the pivot member 22 is inserted into and locked in the lowermost one of the locking grooves 252 of the housing 25 as shown in FIG. 5 to lock the adjusting shank 21 onto the housing 25 and to lock the mounting sleeve 3 onto the armrest support 4.

Referring to FIGS. 13-23, the limit plate 23*a* of the lifting device 2*a* has a substantially rectangular shape and has mediate portion formed with a substantially L-shaped limit slot 234 in which the locking rod 223 of the pivot member 22 is slidable. The limit plate 23*a* of the lifting device 2*a* is movable in concert with the adjusting shank 21 and has a side provided with an upper guide rod 235 slidable in the slideway 251 of the housing 25 and a lower guide rod 236 slidable in the slideway 251 of the housing 25. The upper guide rod 235 of the limit plate 23*a* is located above the limit slot 234, and the lower guide rod 236 of the limit plate 23*a* is located under the limit slot 234. The first side of the adjusting shank 21 has an edge provided with a corrugated first contact face 217, and the limit plate 23*a* of the lifting device 2*a* has an edge provided with a corrugated second contact face 237 slidably contacting with the first contact face 217 of the adjusting shank 21.

Figure 17:
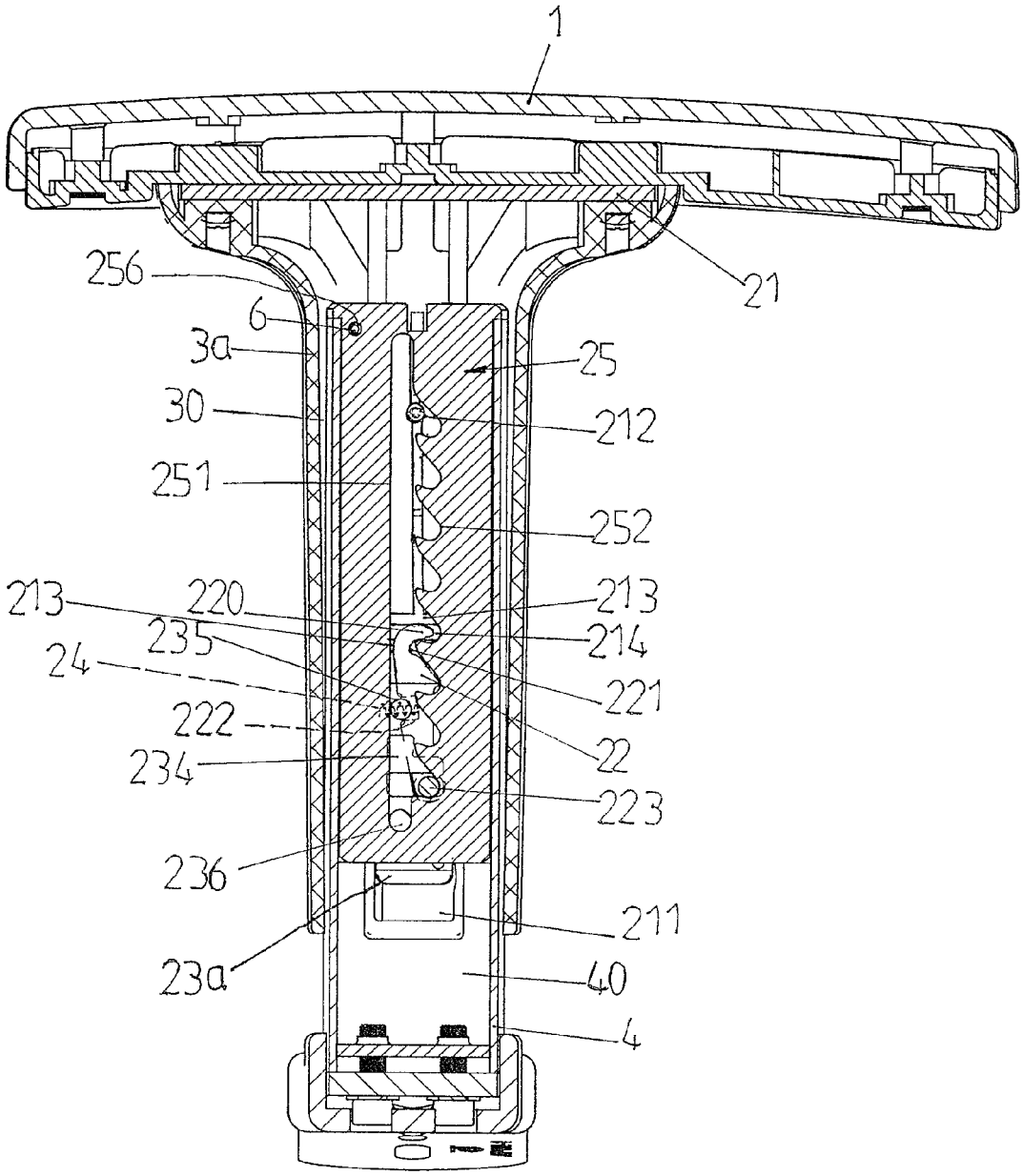
FIG. 17 is a front cross-sectional view of the armrest assembly as shown in FIG. 13.
Figure 18:
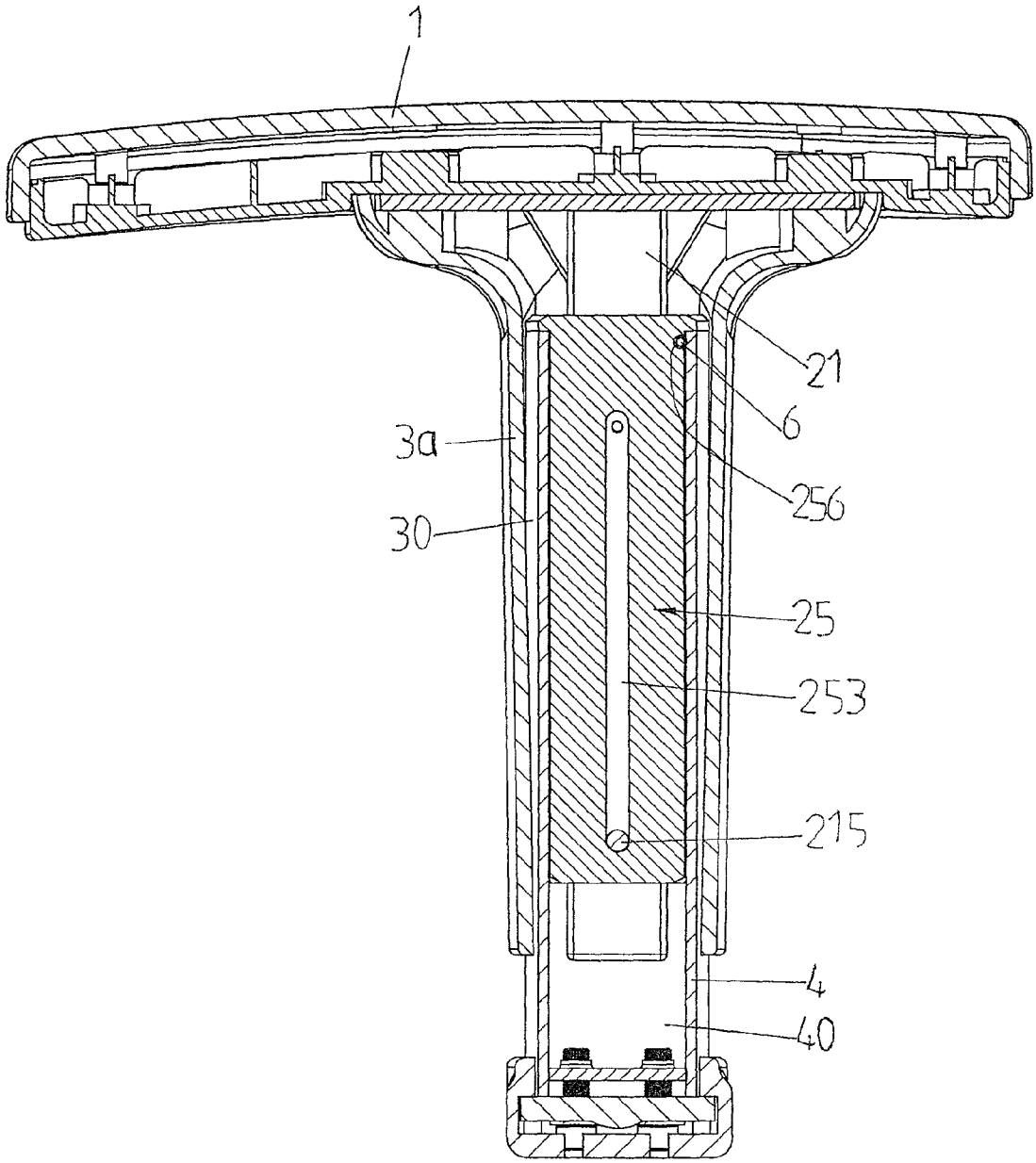
FIG. 18 is a rear cross-sectional view of the armrest assembly as shown in FIG. 13.

Referring to FIGS. 17 and 18 with reference to FIGS. 13-16, when the lifting device 2*a* is disposed at a normal state, the locking rod 223 of the pivot member 22 is located at the lowermost and rightmost side of the limit slot 234 of the limit plate 23*a* and is locked in the lowermost one of the locking grooves 252 of the housing 25 as shown in FIG. 17, the lower guide rod 236 of the limit plate 23*a* is located at the bottom of the slideway 251 of the housing 25 as shown in FIG. 17, and the limit rod 215 is located at the bottom of the guide slot 253 of the housing 25 as shown in FIG. 18.

Figure 19:
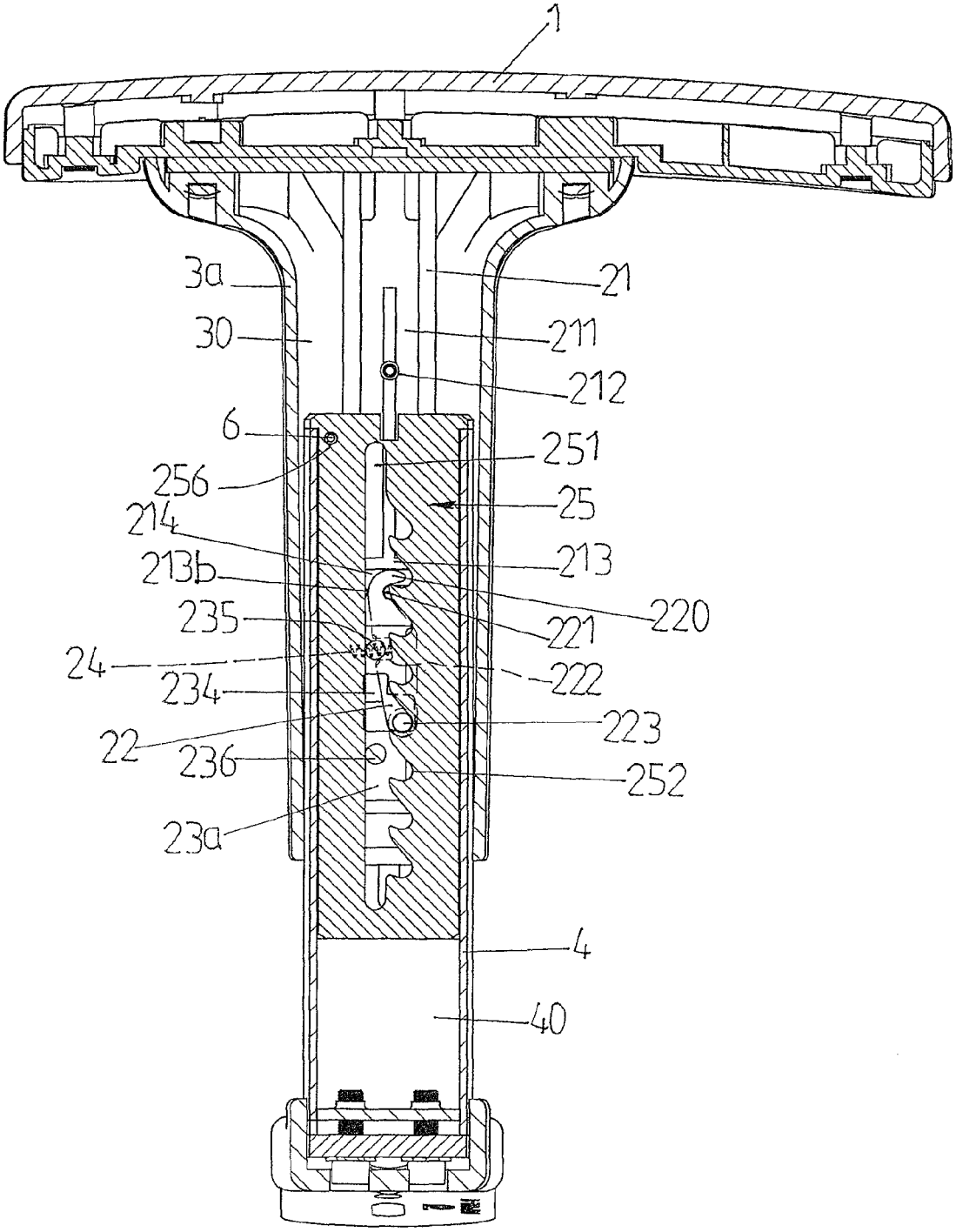
FIG. 19 is a schematic operational view of the armrest assembly as shown in FIG. 17.

In operation, referring to FIGS. 19-23 with reference to FIGS. 13-18, when the armrest 1 is pulled upward, the mounting sleeve 3*a* and the adjusting shank 21 are moved upward relative to the armrest support 4 so that the pivot member 22 is moved upward relative to the housing 25, and the locking rod 223 of the pivot member 22 is pushed leftward by the wall defining the locking grooves 252 of the housing 25 to detach from one of the locking grooves 252 of the housing 25 and to extend into the slideway 251 of the housing 25. At this time, when the locking rod 223 of the pivot member 22 is pushed leftward by the wall defining the locking grooves 252 of the housing 25, the pivot groove 221 of the pivot member 22 is pivoted about the lower one of the two support bars 213 of the adjusting shank 21 so that the pivot member 22 is pivoted leftward to compress the elastic member 24. When the adjusting shank 21 and the pivot member 22 are further moved upward relative to the housing 25, the locking rod 223 of the pivot member 22 is pushed toward the locking grooves 252 of the housing 25 by the restoring force of the elastic member 24 so that the locking rod 223 of the pivot member 22 is inserted into and locked in another one of the locking grooves 252 of the housing 25 as shown in FIG. 19 to lock the adjusting shank 21 onto the housing 25 and to lock the mounting sleeve 3*a* onto the armrest support 4. In such a manner, when the armrest 1 is pulled upward, the mounting sleeve 3*a* is moved upward relative to the armrest support 4 successively so as to adjust the height of the armrest 1 of the chair.

Figure 20:
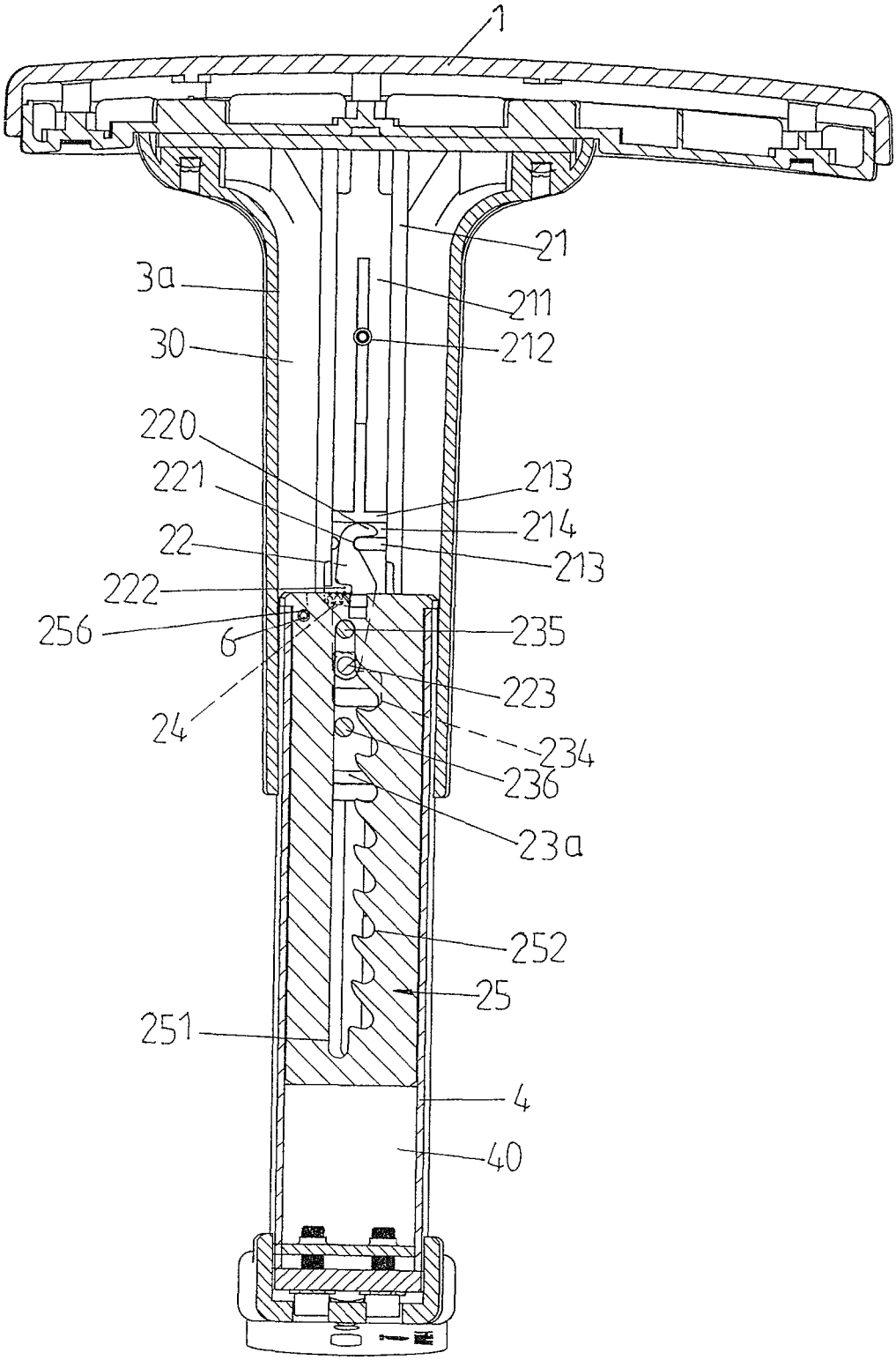
FIG. 20 is a schematic operational view of the armrest assembly as shown in FIG. 19.
Figure 21:
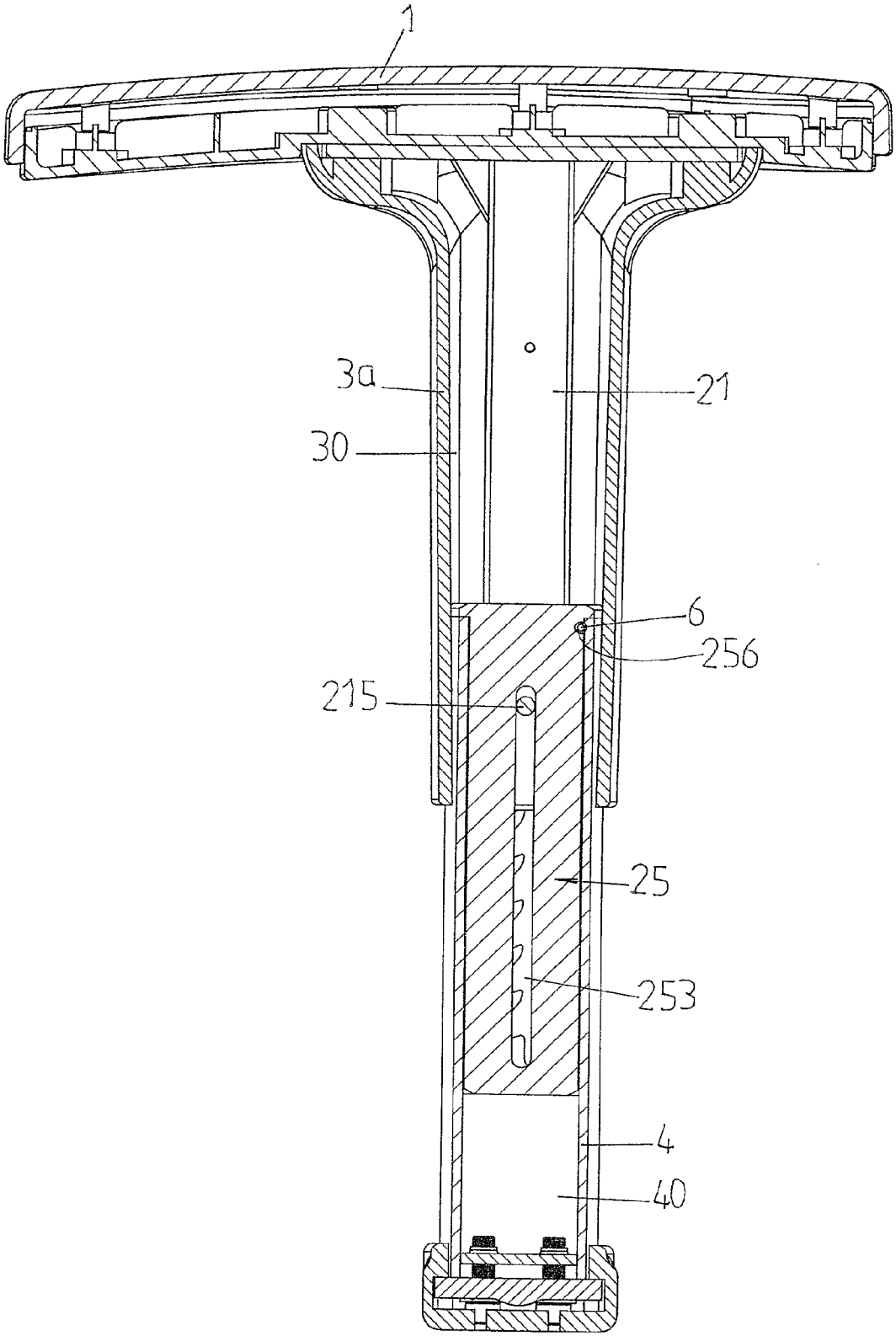
FIG. 21 is a schematic operational view of the armrest assembly as shown in FIG. 18.

As shown in FIGS. 20 and 21, when the adjusting shank 21 and the pivot member 22 are further moved upward relative to the housing 25, the upper guide rod 235 of the limit plate 23*a* is moved upward to abut the top of the slideway 251 of the housing 25 as shown in FIG. 20, so that the limit plate 23*a* is stopped and cannot further be moved upward relative to the housing 25. At this time, the locking rod 223 of the pivot member 22 is pushed leftward by the wall defining the locking grooves 252 of the housing 25 so that the locking rod 223 of the pivot member 22 is detached from the uppermost one of the locking grooves 252 of the housing 25 and is extended into the slideway 251 of the housing 25 as shown in FIG. 20. At the same time, the locking rod 223 of the pivot member 22 is located at the lowermost and leftmost side of the limit slot 234 of the limit plate 23*a*. In addition, a clearance is defined between the limit rod 215 and the top of the guide slot 253 of the housing 25 as shown in FIG. 21 so that the adjusting shank 21 and the pivot member 22 can further be moved upward relative to the housing 25 and the limit plate 23*a*. In such a manner, when the adjusting shank 21 and the pivot member 22 are further moved upward relative to the housing 25 and the limit plate 23*a*, the locking rod 223 of the pivot member 22 is moved upward to abut the uppermost and leftmost side of the limit slot 234 of the limit plate 23*a* as shown in FIG. 20 so that the locking rod 223 of the pivot member 22 is locked by the limit slot 234 of the limit plate 23*a* and cannot be pushed toward the locking grooves 252 of the housing 25 by the restoring force of the elastic member 24. Thus, the adjusting shank 21 and the pivot member 22 are moved downward relative to the housing 25 freely and are moved from the position as shown in FIG. 20 to the position as shown in FIG. 22 so that the mounting sleeve 3*a* is moved downward relative to the armrest support 4 freely and successively so as to lower of the armrest 1 of the chair.

Figure 22:
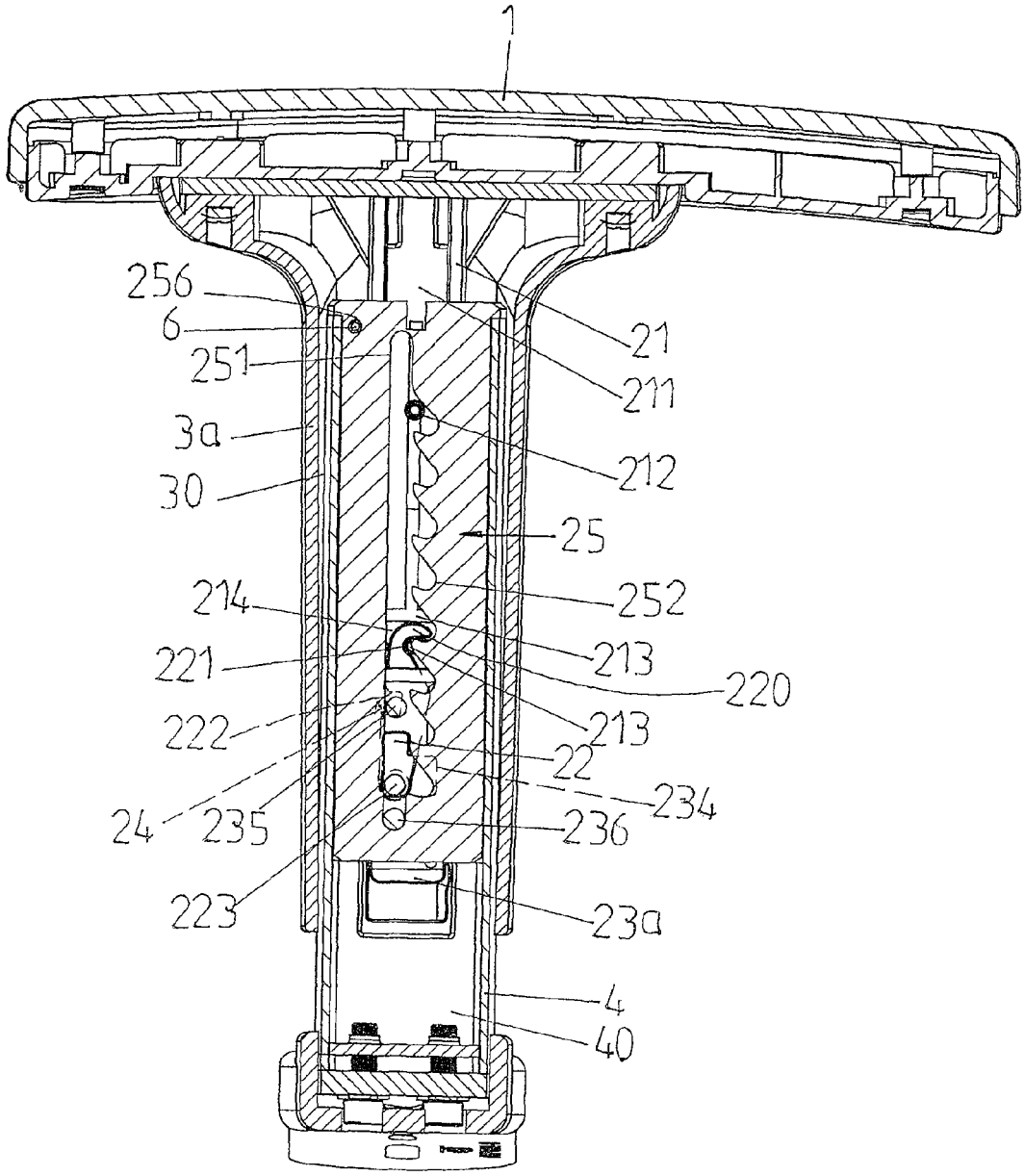
FIG. 22 is a schematic operational view of the armrest assembly as shown in FIG. 20.
Figure 23:
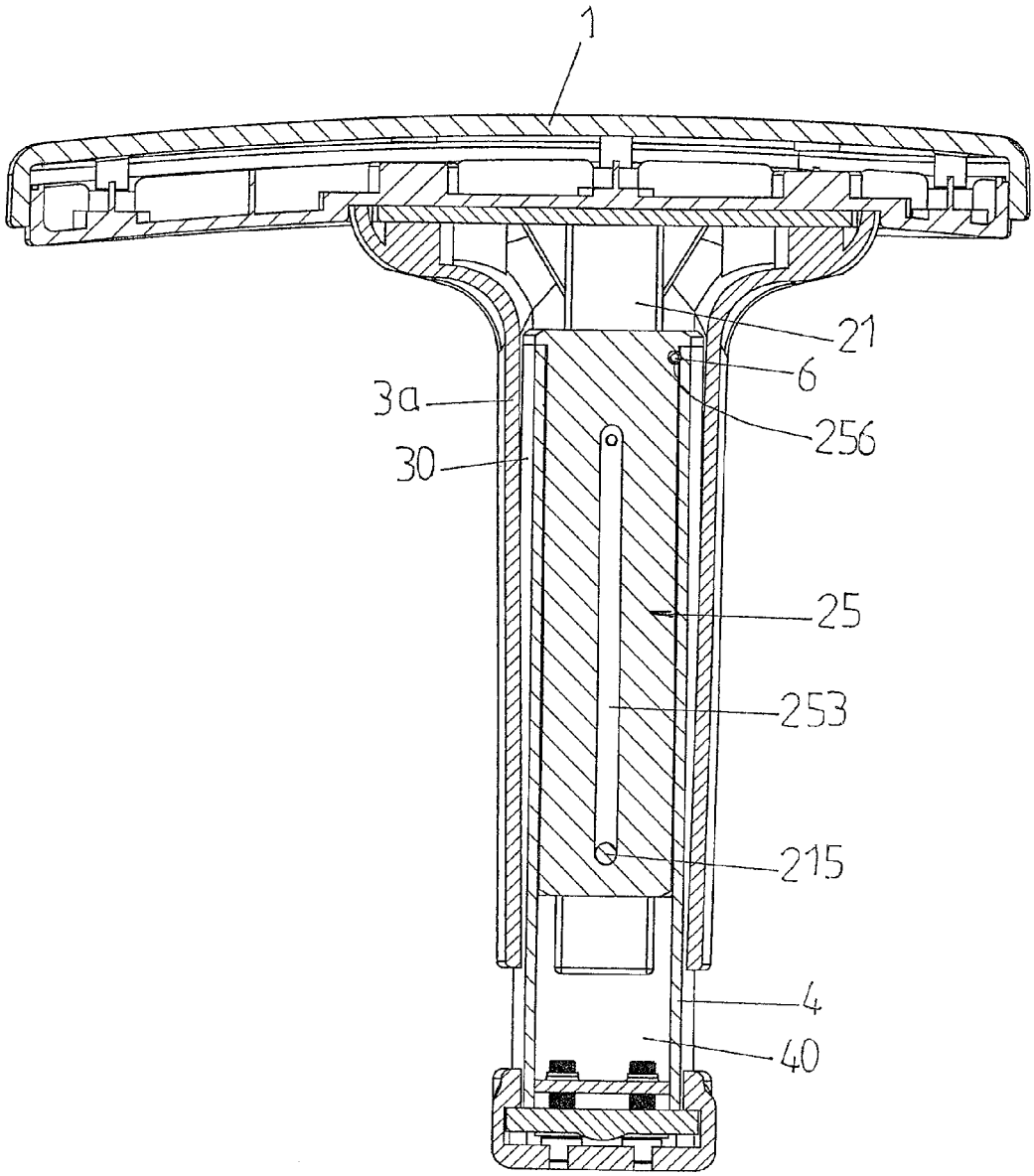
FIG. 23 is a schematic operational view of the armrest assembly as shown in FIG. 21.

As shown in FIGS. 22 and 23, when the adjusting shank 21 and the pivot member 22 are further moved downward relative to the housing 25, the lower guide rod 236 of the limit plate 23*a* is moved downward to abut the bottom of the slideway 251 of the housing 25 as shown in FIG. 22, so that the limit plate 23*a* is stopped and cannot further be moved downward relative to the housing 25. At the same time, a clearance is defined between the limit rod 215 and the bottom of the guide slot 253 of the housing 25 so that the adjusting shank 21 and the pivot member 22 can further be moved downward relative to the housing 25 and the limit plate 23*a* until the limit rod 215 is moved to abut the bottom of the guide slot 253 of the housing 25 as shown in FIG. 23. In such a manner, when the adjusting shank 21 and the pivot member 22 are further moved downward relative to the housing 25 and the limit plate 23*a*, the locking rod 223 of the pivot member 22 is moved downward to abut the lowermost and leftmost side of the limit slot 234 of the limit plate 23*a* as shown in FIG. 22 so that the locking rod 223 of the pivot member 22 is unlocked from the limit slot 234 of the limit plate 23*a* and can be pushed toward the locking grooves 252 of the housing 25 by the restoring force of the elastic member 24. Thus, the locking rod 223 of the pivot member 22 is pushed toward the locking grooves 252 of the housing 25 by the restoring force of the elastic member 24 so that the locking rod 223 of the pivot member 22 is inserted into and locked in the lowermost one of the locking grooves 252 of the housing 25 as shown in FIG. 17 to lock the adjusting shank 21 onto the housing 25 and to lock the mounting sleeve 3*a* onto the armrest support 4.

Accordingly, the mounting sleeve 3 or 3*a* is movable relative to the armrest support 4 so as to adjust the height of the armrest 1 so that the height of the armrest 1 can be adjusted freely to support a user's arm comfortably. In addition, the user only needs to pull the armrest 1 upward to adjust the height of the armrest 1 so that the user can adjust the height of the armrest 1 easily and quickly in an energy-saving manner. Further, the adjusting shank 21 is moved on the housing 25 by guidance of the limit rod 215 so that the mounting sleeve 3 or 3*a* is movable relative to the armrest support 4 smoothly and stably so as to facilitate the user adjusting the height of the armrest 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest assembly, comprising:

an armrest support;

a mounting sleeve movably mounted on the armrest support;

an armrest mounted on the mounting sleeve to move in concert with the mounting sleeve; and a lifting device mounted between the armrest support and the mounting sleeve and operable between a first position where the lifting device is locked to lock the mounting sleeve onto the armrest support and a second position where the lifting device is unlocked to unlock the mounting sleeve from the armrest support so that the mounting sleeve is movable relative to the armrest support freely to adjust a relative position between the mounting sleeve and the armrest support;

wherein the lifting device includes:

a housing secured in the armrest support and having a first side formed with an elongate slideway which has a sidewall formed with a plurality of locking grooves and a second side formed with an elongate guide slot;

an adjusting shank movably mounted on the housing and secured in the mounting sleeve to move in concert with the mounting sleeve;

a pivot member mounted on a first side of the adjusting shank to move in concert with the adjusting shank and having an upper end pivotally mounted on the adjusting shank and a lower end provided with a locking rod movable in the slideway of the housing and detachably locked in one of the locking grooves of the housing;

an elastic member mounted on the first side of the adjusting shank and biased between the adjusting shank and the pivot member to push the locking rod of the pivot member toward one of the locking grooves of the housing;

a limit rod mounted on a second side of the adjusting shank to move in concert with the adjusting shank and movable in the guide slot of the housing; and a limit plate movably mounted on the first side of the adjusting shank and connected with the locking rod of the pivot member to drive the locking rod of the pivot member to detach from the locking grooves of the housing.

2. The armrest assembly of claim 1, wherein the armrest support is hollow and has an inner portion formed with a receiving chamber to receive the lifting device;

the armrest support has an upper end formed with two opposite pin holes each connected to the receiving chamber;

the housing of the lifting device is mounted in the receiving chamber of the armrest support and has an upper end provided with a pin bore aligning with the two pin holes of the armrest support; and the armrest further comprises a fixing pin extending through the two pin holes of the armrest support and the pin bore of the housing to secure the housing of the lifting device to the armrest support.

3. The armrest assembly of claim 1, wherein the mounting sleeve has an enlarged top formed with two through holes;

the adjusting shank of the lifting device has an elongate top formed with two through bores;

the armrest is mounted on the top of the mounting sleeve;

the armrest has a bottom provided with two screw bores; and the armrest further comprises two fixing screws in turn extended through the through holes of the mounting sleeve and the through bores of the adjusting shank respectively and screwed into the screw bores of the armrest respectively to combine the armrest, the mounting sleeve and the adjusting shank of the lifting device.

4. The armrest assembly of claim 1, wherein the adjusting shank of the lifting device has a substantially T-shaped profile.

5. The armrest assembly of claim 1, wherein the mounting sleeve is hollow and has an inner portion formed with a mounting hole slidably mounted on the armrest support.

6. The armrest assembly of claim 5, wherein the mounting sleeve has a side face formed with a passage connected to the mounting hole;

the limit plate of the lifting device has a top formed with a bent extension extending through and protruding outwardly from the passage of the mounting sleeve;

the armrest assembly further comprises a control knob mounted on the extension of the limit plate to drive and move the limit plate relative to the adjusting shank.

7. The armrest assembly of claim 6, wherein the control knob is located outside of the mounting sleeve and has a side formed with a socket mounted on the extension of the limit plate.

8. The armrest assembly of claim 1, wherein the first side of the adjusting shank is formed with a receiving channel which receives the pivot member, the limit plate and the elastic member.

9. The armrest assembly of claim 1, wherein the first side of the adjusting shank has a lower end provided with two support bars and a receiving space between the two support bars;

the upper end of the pivot member is formed with an arcuate pivot groove pivotally mounted on a lower one of the two support bars of the adjusting shank;

the upper end of the pivot member is formed with a hooked limit block movably mounted in the receiving space of the adjusting shank and limited between the two support bars of the adjusting shank.

10. The armrest assembly of claim 9, wherein the pivot member of the lifting device has a mediate portion formed with a receiving recess which receives the elastic member.

11. The armrest assembly of claim 10, wherein the receiving recess of the pivot member is located between the pivot groove and the locking rod of the pivot member.

12. The armrest assembly of claim 9, wherein the limit block of the pivot member is located above the pivot groove of the pivot member.

13. The armrest assembly of claim 1, wherein the housing of the lifting device consists of two recessed support boards which are combined together;

one of the two support boards of the housing has a periphery provided with a plurality of locating holes;

the other one of the two support boards of the housing has a periphery provided with a plurality of locating stubs inserted into the locating holes so that the two support boards of the housing are combined together.

14. The armrest assembly of claim 1, wherein the limit plate of the lifting device has lower end formed with a substantially inverted L-shaped limit slot in which the locking rod of the pivot member is slidable.

15. The armrest assembly of claim 14, wherein the first side of the adjusting shank has an upper end provided with a stop stub;

the limit plate of the lifting device is movable in concert with the adjusting shank and has an upper end formed with an oblong sliding slot slidable on the stop stub of the adjusting shank.

16. The armrest assembly of claim 14, wherein the limit plate of the lifting device has a substantially inverted L-shaped cross-sectional profile;

the limit slot of the limit plate has a side formed with a guide ramp to guide movement of the locking rod of the pivot member relative to the limit slot of the limit plate.

17. The armrest assembly of claim 1, wherein the limit plate of the lifting device has mediate portion formed with a substantially L-shaped limit slot in which the locking rod of the pivot member is slidable.

18. The armrest assembly of claim 17, wherein the limit plate of the lifting device is movable in concert with the adjusting shank and has a side provided with an upper guide rod slidable in the slideway of the housing and a lower guide rod slidable in the slideway of the housing.

19. The armrest assembly of claim 18, wherein the limit plate of the lifting device has a substantially rectangular shape;

the upper guide rod of the limit plate is located above the limit slot;

the lower guide rod of the limit plate is located under the limit slot.

20. The armrest assembly of claim 17, wherein the first side of the adjusting shank has an edge provided with a corrugated first contact face;

the limit plate of the lifting device has an edge provided with a corrugated second contact face slidably contacting with the first contact face of the adjusting shank.

* * * * *